US008770267B2

(12) United States Patent
Nagashima et al.

(10) Patent No.: US 8,770,267 B2
(45) Date of Patent: Jul. 8, 2014

(54) ADSORPTION MODULE AND METHOD OF MANUFACTURING THE SAME

(75) Inventors: Hisao Nagashima, Okazaki (JP); Masaaki Tanaka, Nagoya (JP); Satoshi Inoue, Kariya (JP); Hiroshi Mieda, Kariya (JP); Seiji Inoue, Nukata-gun (JP); Katsuya Komaki, Kariya (JP)

(73) Assignee: Denso Corporation, Kariya (JP)

( * ) Notice: Subject to any disclaimer, the term of this patent is extended or adjusted under 35 U.S.C. 154(b) by 656 days.

(21) Appl. No.: 11/904,585

(22) Filed: Sep. 27, 2007

(65) Prior Publication Data

US 2008/0078532 A1 Apr. 3, 2008

(30) Foreign Application Priority Data

Sep. 29, 2006 (JP) ..... 2006-269094
Aug. 10, 2007 (JP) ..... 2007-210254

(51) Int. Cl.

| | |
|---|---|
| ***B22F 3/11*** | (2006.01) |
| ***F28D 15/00*** | (2006.01) |
| ***F28D 7/10*** | (2006.01) |
| ***F28D 7/02*** | (2006.01) |
| ***F25B 17/08*** | (2006.01) |
| ***F25B 15/12*** | (2006.01) |
| ***F25B 15/00*** | (2006.01) |
| ***B21D 53/06*** | (2006.01) |
| ***B23P 15/26*** | (2006.01) |
| ***F25B 35/04*** | (2006.01) |
| ***F28D 7/16*** | (2006.01) |
| ***F28F 13/00*** | (2006.01) |

(52) U.S. Cl.

CPC ... *F28D 7/16* (2013.01); *B22F 3/11* (2013.01); *F25B 35/04* (2013.01); *F28F 13/003* (2013.01)

USPC ..... 165/104.34; 165/157; 165/164; 62/480; 62/484; 62/485; 29/890.049; 419/2

(58) Field of Classification Search

USPC ..... 62/484, 480, 485; 165/104.34, 157, 165/164; 419/2

See application file for complete search history.

(56) References Cited

U.S. PATENT DOCUMENTS 3,587,732 A * 6/1971 Burne ..... 165/158
3,595,310 A * 7/1971 Burne et al. ..... 165/161

(Continued)

FOREIGN PATENT DOCUMENTS

| | | |
|---|---|---|
| JP | 04-148194 | 5/1992 |
| JP | 2002-031426 | 1/2002 |
| JP | 2006-200870 | 8/2006 |

*Primary Examiner* — Allen Flanigan
*Assistant Examiner* — Filip Zec
(74) *Attorney, Agent, or Firm* — Harness, Dickey & Pierce, PLC

(57) ABSTRACT

An adsorption module has heat medium pipes through which a fluid flows, a porous heat transferring member, and adsorbent. The porous heat transferring member is a sintered body formed by sintering a metallic material that is in a form of one of powders, particles and fibers, and has pores for allowing an adsorbed medium to pass through. The porous heat transferring member is disposed on peripheries of the heat medium pipes and bonded to outer surfaces of the heat medium pipes by sintering. The adsorbent is disposed in the pores. The porous heat transferring member further has an adsorbed medium passage for allowing the adsorbed medium to pass through. The adsorbed medium passage is located between the heat medium pipes, and extends straight and parallel to axes of the heat medium pipes.

20 Claims, 17 Drawing Sheets

(56) References Cited

U.S. PATENT DOCUMENTS 3,776,303 A * 12/1973 Anderson et al. ..... 165/82
4,625,791 A * 12/1986 Lane et al. ..... 165/115
4,991,644 A * 2/1991 Miaoulis et al. ..... 165/52
5,005,371 A * 4/1991 Yonezawa et al. ..... 62/238.6
5,291,942 A * 3/1994 Ryan ..... 165/104.12
5,518,977 A * 5/1996 Dunne et al. ..... 502/68
5,542,267 A * 8/1996 Lee et al. ..... 62/485
5,693,230 A * 12/1997 Asher ..... 210/650
6,645,271 B2 * 11/2003 Seguin et al. ..... 95/90
6,672,103 B1 * 1/2004 Stach et al. ..... 62/480
6,709,622 B2 * 3/2004 Billiet et al. ..... 264/432
2005/0061483 A1 * 3/2005 Dunne et al. ..... 165/104.12

* cited by examiner

ADSORPTION MODULE AND METHOD OF MANUFACTURING THE SAME

CROSS REFERENCE TO RELATED APPLICATION

This application is based on Japanese Patent Applications No. 2006-269094 filed on Sep. 29, 2006 and No. 2007-210254 filed on Aug. 10, 2007, the disclosures of which are incorporated herein by reference.

FIELD OF THE INVENTION

The present invention relates to an adsorption module and a method of manufacturing the same.

BACKGROUND OF THE INVENTION

An adsorption module is for example used for an adsorber in which a refrigerant is evaporated by an adsorptive activity of adsorbent that adsorbs gas-phase refrigerant, and a refrigerating capability is provided due to latent heat of evaporation.

For example, Japanese Unexamined Patent Publication No. 4-148194 describes an adsorber including a first heat exchanger filled with adsorbent and a second heat exchanger in which an adsorbed medium to be adsorbed in and desorbed from the adsorbent is evaporated and condensed. The first heat exchanger and the second heat exchanger are enclosed in a closed container in a vacuum state. The first heat exchanger includes an adsorbent molded body and heat medium pipes through which a heat exchange medium flows. The adsorbent molded body is formed by mixing copper powder as a heat transfer accelerating material with adsorbent and sintering the mixture. The heat medium pipes are integrally molded in the adsorbent molded body. For example, the first heat exchanger and the second heat exchanger are separately formed, and then air-tightly assembled in the closed vacuum container.

In the adsorbent molded body, the sintered member of the copper powder serves as heat transfer fins, and contact surface area between the fins and the adsorbent filled in the fin is increased to improve a heat transfer characteristic.

SUMMARY OF THE INVENTION

In an adsorption module, adsorption and desorption speed is likely to be affected by a thickness of adsorbent filled layer on a periphery of a heat medium pipe due to diffusion resistance of an adsorbed medium when the adsorbed medium is adsorbed by and desorbed from the adsorbent. This affects a cooling efficiency.

The present invention is made in view of the foregoing matter, and it is an object of the present invention to provide an adsorption module capable of reducing the diffusion resistance of the adsorbed medium, and a method of manufacturing the adsorption module. It is another object of the present invention to provide an adsorption module having an improved heat transfer characteristic while reducing the diffusion resistance of the adsorbed medium, and a method of manufacturing the adsorption module.

According to an aspect of the present invention, an adsorption module includes a plurality of heat medium pipes that allows a heat exchange medium to pass through, a porous heat transferring member disposed on peripheries of the heat medium pipes, adsorbent disposed in pores of the porous heat transferring member, and an adsorbed medium passage defined in the porous heat transferring member. The porous heat transferring member is a sintered body formed by sintering a metallic material in a form of one of powders, particles and fibers, and is connected to outer surfaces of the heat medium pipes by metal-to-metal bonding. The porous heat transferring member includes the pores for allowing an adsorbed medium to pass through. The adsorbed medium passage is provided in the porous heat transferring member for allowing the adsorbed medium to flow. The adsorbed medium passage is located between the heat medium pipes, and extends straight along axes of the heat medium pipes.

Namely, the porous heat transferring member has the pores that are formed by the sintering of the metallic member such as in a three-dimensional mesh-like shape, and the adsorbed medium passage is defined in the porous heat transferring member as a space different from the pores. Since the adsorbed medium passage extends straight and parallel to the axes of the heat medium pipes between the heat medium pipes, the adsorbed medium is easily diffused into the porous heat transferring member and easily reaches the adsorbent disposed in the pores. With the arrangement of the adsorbed medium passage, an osmotic distance between an inner surface of the adsorbed medium passage to the outer surface of the heat medium pipe is substantially uniform along the axis of the heat medium pipe. Therefore, the adsorbed medium is smoothly diffused into the porous heat transferring member, and hence diffusion resistance of the adsorbed medium is reduced.

According to another aspect of the present invention, a method of manufacturing an adsorption module includes: arranging a heat medium pipe and a passage-forming jig for forming a space for an adsorbed medium passage in a casing; introducing metallic powder and adsorbent in the casing through an opening of the casing; removing the passage-forming jig from the casing; closing the opening of the casing; and heating the casing in a furnace such that the metallic powder is sintered and the heat medium pipe and the casing are brazed.

Accordingly, sintering of the metallic powder and brazing of the heat medium pipe and the casing are performed at the same time by heating the casing. A porous heat transferring member is formed by sintering the metallic powder. The space for the adsorbed medium passage is easily formed in the porous heat transferring member by removing the passage-forming jig from the casing in which the metallic powder and adsorbent are introduced and heating the casing.

According to further another aspect of the present invention, a method of manufacturing an adsorption module includes; arranging a heat medium pipe in a casing; introducing metallic powder and adsorbent in the casing through an opening; applying a force to a surface of the metallic powder and adsorbent introduced in the casing by a pressing part of a pressing jig for compacting the metallic powder and adsorbent while inserting a passage-forming rod in the casing; removing the pressing jig such that the space for the adsorbed medium passage is formed in a compacted metallic powder and adsorbent; closing the opening of the casing; and heating the casing in a furnace such that the metallic powder is sintered and the heat medium pipe and the casing are brazed.

In this case, the passage-forming rod is integrated with the pressing part. The space for the adsorbed medium passage is formed by the passage-forming rod at the same time as compacting the metallic powder and the adsorbent by the pressing part. Therefore, the number of steps reduces. Also in this case, the sintering of the metallic powder and the brazing of the heat medium pipe and the casing are performed at the same time by heating the casing.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS

First Embodiment

Figure 1:
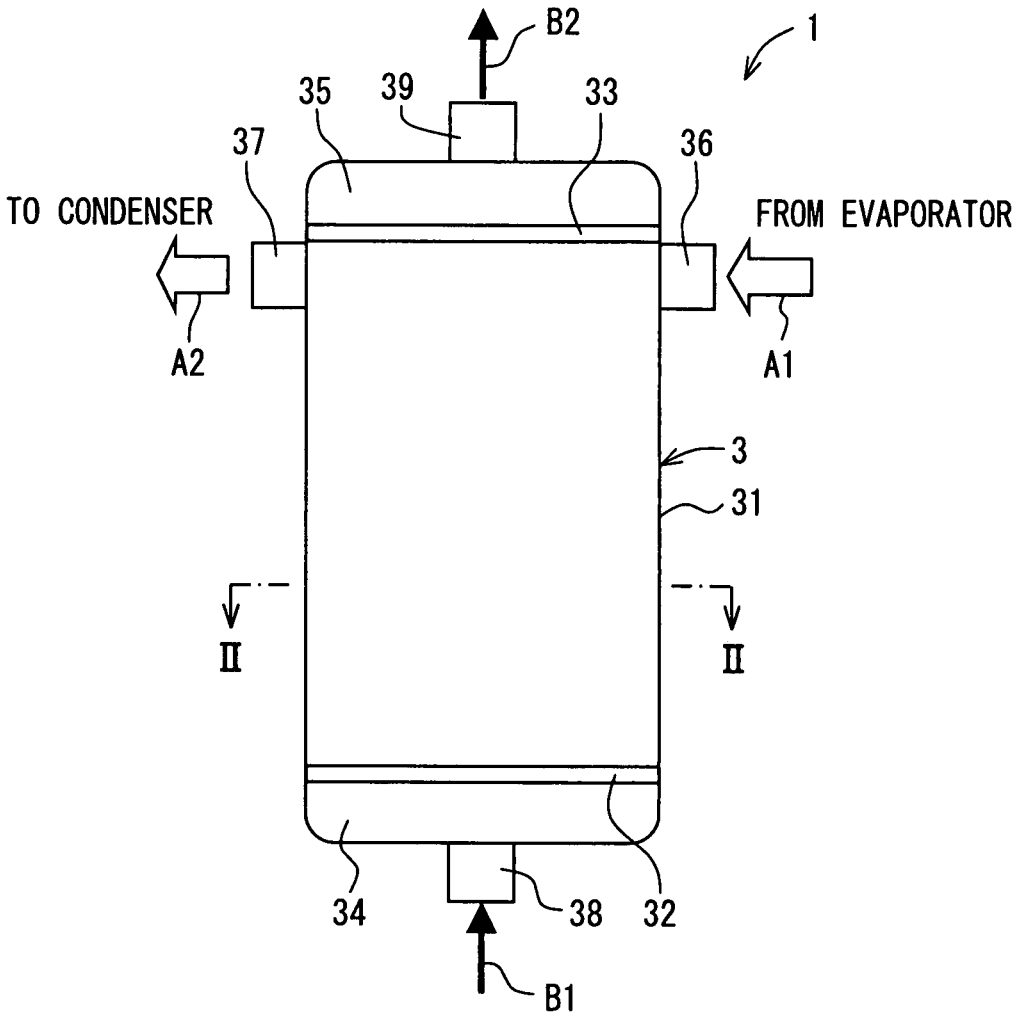
FIG. 1 is a side view of an adsorption module according to a first embodiment of the present invention.
Figure 2:
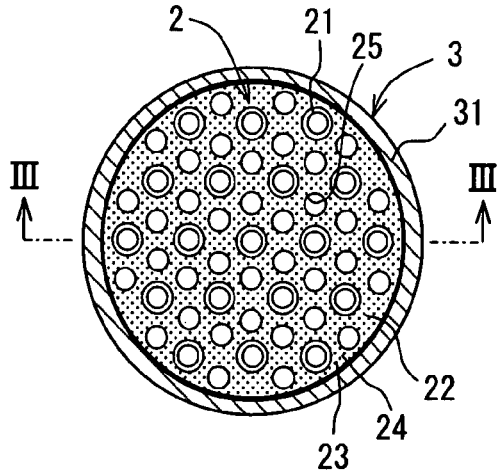
FIG. 2 is a cross-sectional view of the adsorption module taken along a line II-II in FIG. 1.
Figure 3:
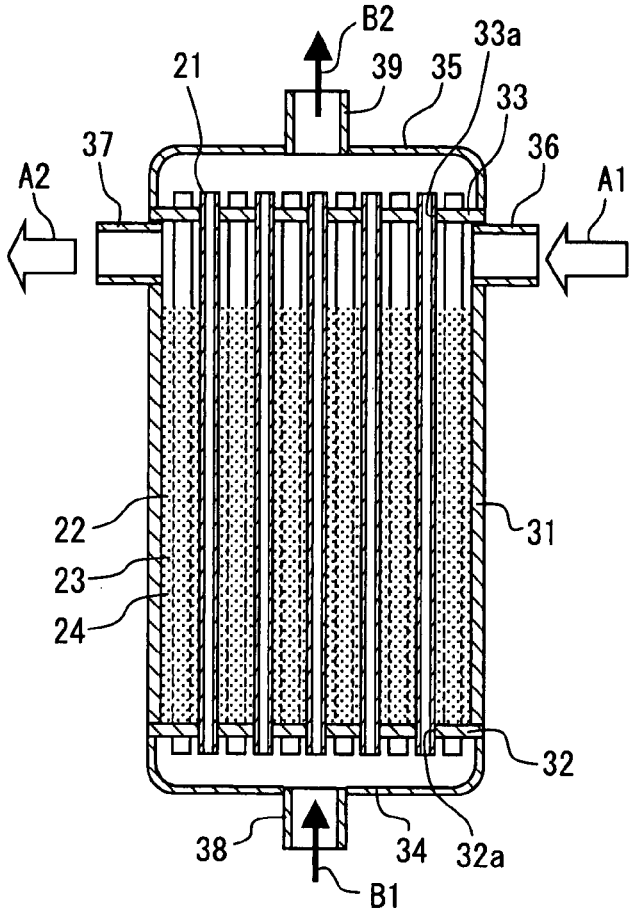
FIG. 3 is a cross-sectional view of the adsorption module taken along a line III-III in FIG. 2.

A first embodiment of the present invention will now be described. As shown in FIGS. 1 to 3, an adsorption module 1 is for example employed in an adsorption refrigerating apparatus that provides a refrigerating capability due to latent heat of evaporation caused by evaporation of refrigerant using an adsorption activity of adsorbent contained in the adsorption module 1. The adsorption module 1 can be employed in an air conditioning apparatus for a vehicle, for example.

Figure 4A:
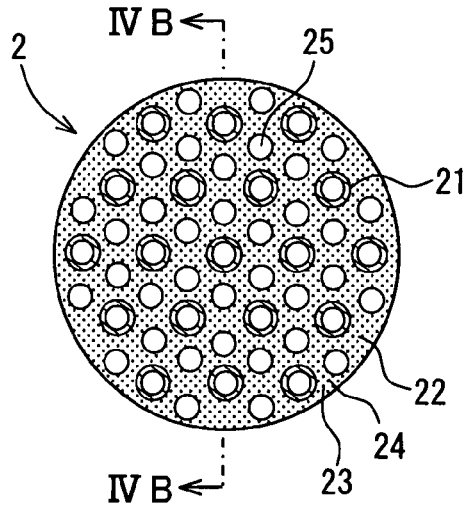
FIG. 4A is a schematic cross-sectional view of a heat exchanging part of the adsorption module according to the first embodiment.
Figure 4B:
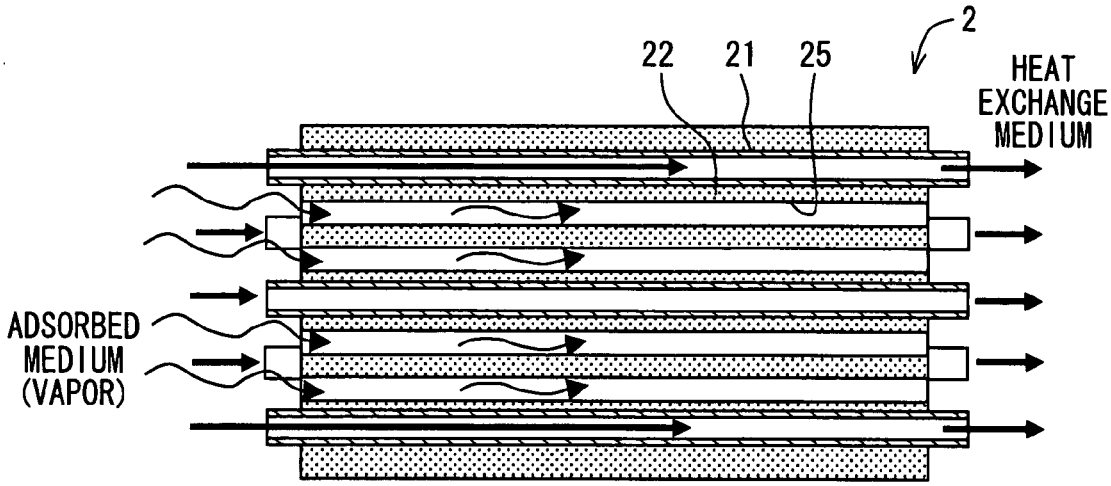
FIG. 4B is a schematic cross-sectional view of the heat exchanging part taken along an line IVB-IVB in FIG. 4A.
Figure 6:
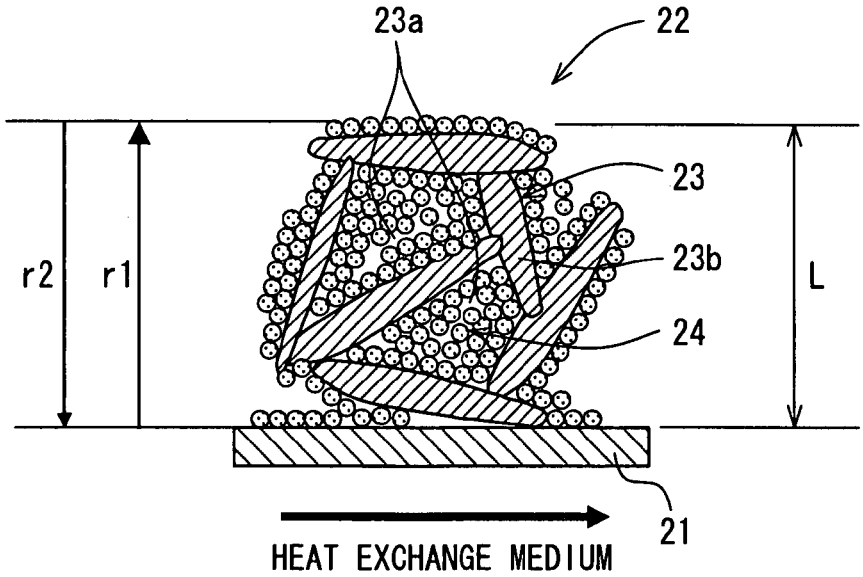
FIG. 6 is a schematic enlarged cross-sectional view of an adsorbent filled layer of the heat exchanging part shown in FIG. 5.

As shown in FIGS. 2 and 3, the adsorption module 1 generally includes a casing 3 and an adsorption heat exchanger (heat exchanging part) 2 housed in the casing 3. As shown in FIGS. 4A, 4B, and 6, the adsorption heat exchanger 2 includes heat medium pipes 21 through which a heat exchange medium (refrigerant) flows, a porous heat transferring member 23 disposed on peripheral areas (peripheral portions) 22 of the heat medium pipes 21, and adsorbent 24.

The heat medium pipes 21 are made of copper or copper alloy. The porous heat transferring member 23 has pores 23*a*, and the pores 23*a* are filled with the adsorbent 24. In the first embodiment, the heat medium pipes 21 are made of copper, for example.

The porous heat transferring member 23 is a sintered body that is formed by heating metallic powder 23*b* having high heat conductivity so that particles of the metallic powder 23*b* are adhered to each other without being melt. In other words, in the porous heat transferring member 23, particles of the metallic powder 23*b* are connected by sintering (hereafter, referred to as sintered connection).

During the sintering, three-dimensional mesh-like small holes are formed in the sintered body due gaps existing between the particles of metallic powder 23*b*. The pores 23*a* are provided by the small holes. The above sintered connection without melting means to fuse only surface layers or surface portions of the particles of the metallic powder 23*b*. That is, during the sintering, contact portions of the particles of the metallic powder 23*b* are bonded by metal-to-metal bonding while remaining the gaps between the particles of the metallic powder 23*b*. For example, the metallic powder 23*b* is made of copper or copper alloy, and is in the form of one of powders, particles, and fibers. In the example shown in FIG. 6, the metallic powder 23*b* is made of copper and in the form of fibers.

The porous heat transferring member 23 provides a sintered fin having the fine pores 23*a* (hereafter, also referred to as the porous sintered fin), as shown in FIG. 3. The pores 23*a* are matched such that fine particles of the adsorbent 24 can be contained therein.

The porous heat transferring member 23 is formed on the peripheral portion 22 of the cylindrical heat medium pipes 21. The porous heat transferring member 23 is bonded with outer surfaces of the heat medium pipes by metal-to metal bonding. The porous heat transferring member 23 has a generally cylindrical shape extending in a direction, as shown in FIGS. 4A and 4B. For example, the porous heat transferring member 23 has an axis that is parallel to axes of the cylindrical heat medium pipes 21.

The adsorbent 24 is in the form of fine particles. The adsorbent 24 is, for example, silica gel or zeolite. The particles of the adsorbent 24 are contained in the pores 23*a* of the porous heat transferring member 23.

The adsorption heat exchanger 2 further includes adsorbed medium passages 25 through which an adsorbed medium (hereafter, vapor) to be adsorbed by the adsorbent 24 flows. The adsorbed medium passages 25 are formed between the heat medium pipes 21 in the porous heat transferring member 23. In the heat transferring member 23, spaces for the adsorbed medium passages 25 are formed differently from the pores 23*a*. The adsorbed medium passages 25 extend straight in one direction. Specifically, the adsorbed medium passages 25 extend parallel to the axes of the heat medium pipes 21.

Namely, in the porous heat transferring member 23, the adsorbed medium passages 25 are formed differently from the pores 23*a*. Further, the adsorbed medium passages 25 are located between the heat medium pipes 21 and extend parallel to the heat medium pipes 21. Therefore, the vapor flowing through the adsorbed medium passages 25 easily pass through the porous heat transferring member 23 and reaches the adsorbent 24 contained in the pores 23*a*. Accordingly, an adsorbent speed improves.

Figure 5:
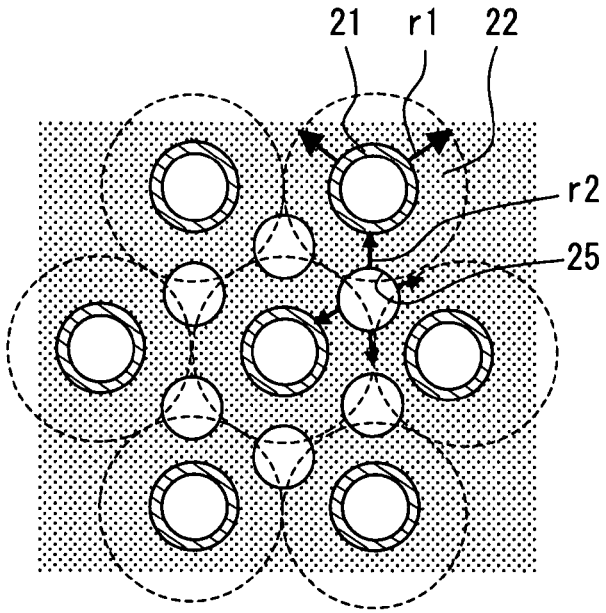
FIG. 5 is a partial enlarged view of the heat exchanging part shown in FIG. 4A.

In the example shown in FIGS. 4A, 4B and 5, each of the adsorbed medium passages 25 has a circular-shaped cross-section, for example. However, the cross-sectional shape of the adsorbed medium passage 25 may be any other shapes such as an elliptical shape, or a rectangular shape.

As shown in FIG. 5, each of the adsorbed medium passages 25 is located in an area that is surrounded by three heat medium pipes 21, for example. Alternatively, the adsorbed medium passage 25 may be located in an area that is surrounded by any other number of the heat medium pipes 21 (e.g., four or five).

The vapor can flow through the adsorbed medium passages 25, such as, in a direction perpendicular to a paper of FIG. 2. During the adsorption, the adsorbed medium passages 25 allows the vapor flowing from an evaporator (arrow A1 in FIG. 1) to pass through so that the vapor smoothly osmosis into the porous heat transferring member 23. On the other hand, during a desorption, the adsorbed medium passages 25 allows the vapor that flows out from the porous heat transferring member 23 to pass through so that the vapor is smoothly introduced toward a condenser (arrow A2 in FIG. 1).

The adsorbed medium passages 25 are preferably arranged parallel to the axes of the heat medium pipes 21. With this, an osmotic distance r2 from an inner surface of the adsorbed medium passage 25 to the outer surface of the heat medium pipe 21 is uniform across the length of the adsorbed medium passages 25, as shown in FIGS. 5 and 6.

The porous heat transferring member 23 is formed on the peripheries of the heat medium pipes 21. Hereafter, portions of the porous heat transferring member 23, which are located on the peripheries of the heat medium pipes 21 are referred to as peripheral portions 22. In the first embodiment, the peripheral portion 22 of one heat medium pipe 21 and the peripheral portion 22 of the adjacent heat medium pipe 21 are integrally formed. Namely, the peripheral portions 22 of the plural heat medium pipes 21 are integrally formed to have a cylindrical outer shape.

In other words, the peripheral portion 22 of each heat medium pipe 21 is a portion of the porous heat transferring member 23. In the example shown in FIG. 5, the peripheral portion 22 corresponds to a portion encompassed by a dashed circle. Hereafter, the peripheral portion 22 is also referred to as an adsorbent filled layer. The adsorbent filled layer corresponds to the porous sintered fin, and has a thickness L, as shown in FIG. 6.

In the adsorbent filled layers shown in FIG. 5, a half of a distance between the outer surfaces of the adjacent heat medium pipes 21 is defined as a heat transferring distance r1. The distance from the inner surface of the adsorbed medium passage 25 to the outer surface of the heat medium pipe 21 is defined as the osmotic distance (osmotic depth) r2.

In a case that the adsorbed medium passage 25 is always disposed between the outer surfaces of the adjacent heat medium pipes 21 (e.g., as a later described fourth embodiment), the heat transferring distance r1 is defined by a half of a length that is obtained by subtracting a dimension of the adsorbed medium passage 25 from the distance between the outer surfaces of the adjacent heat medium pipes 21.

Because the adsorption and desorption speeds are affected by the osmotic distance r2 and the heat transferring distance r1, it is ideal that the osmotic distance r2 and the heat transferring distance r1 are substantially equal. However, if the heat medium pipes 21 and the adsorbed medium passages 25 are arranged in the porous heat transferring member 23 to satisfy the above condition, the shape of the adsorbed medium passages 25 and the structure of the porous heat transferring member 23 may be limited.

Therefore, a condition of the adsorbent filled layer, which is capable of improving a heat transferring characteristic while reducing a diffusion resistance of the adsorbed medium even if the heat transferring distance r1 is different from the osmotic distance r2, is studied, and the following condition regarding the thickness L of the adsorbent filed layer is found.

Figure 7A:
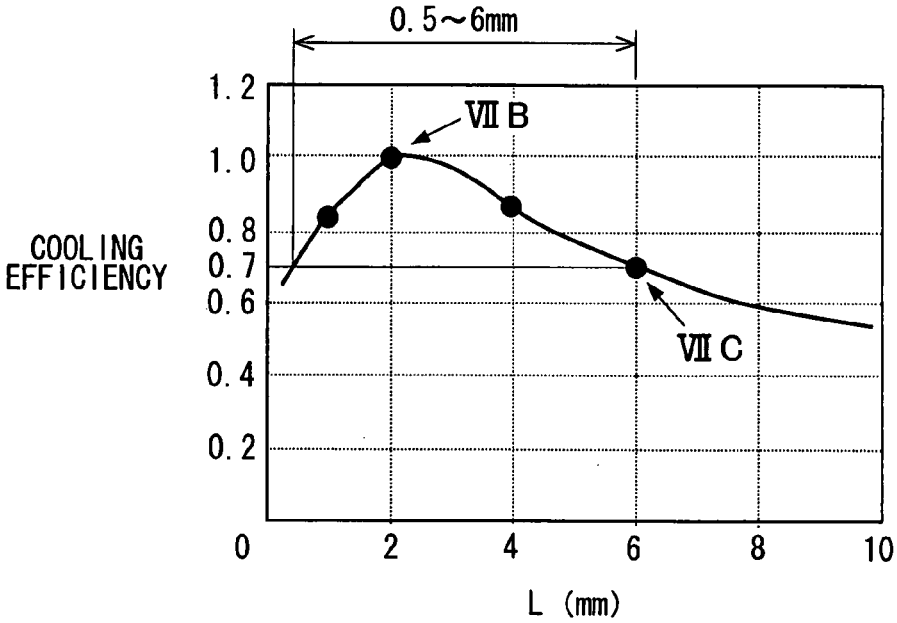
FIG. 7A is a graph showing a relationship between a thickness L of the adsorbent filled layer and a cooling efficiency per unit volume, according to the first embodiment.
Figure 8A:
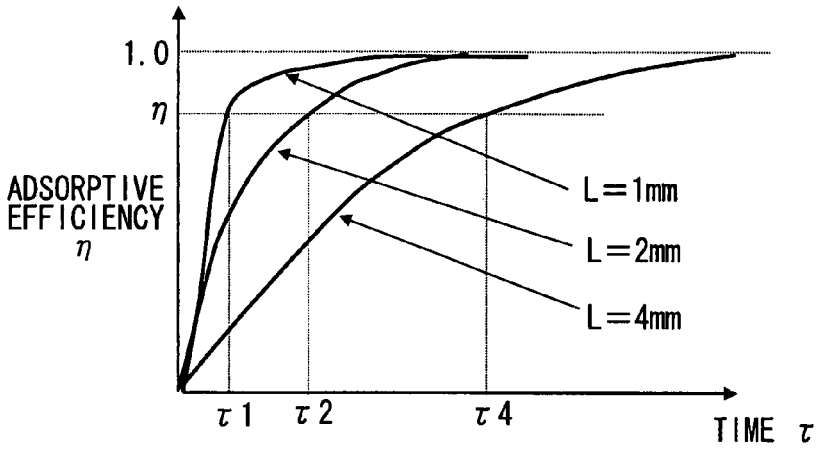
FIG. 8A is a graph showing a relationship between time and an adsorptive efficiency of adsorbent filled layers having different thickness according to the first embodiment.

Referring to FIGS. 7A and 8A, a relationship between the thickness L and a cooling efficiency will now be described. In FIG. 7A, a horizontal axis represents the thickness L of the adsorbent filled layer (porous sintered fin), and a vertical axis represents the cooling efficiency per unit volume. The cooling efficiency is denoted by a ratio of a cooling capacity of the adsorbent filled layer to a maximum efficiency. The cooling efficiency is calculated based on a test result of an adsorption speed ($\eta/\tau$) shown in FIG. 8A.

Figure 8B:
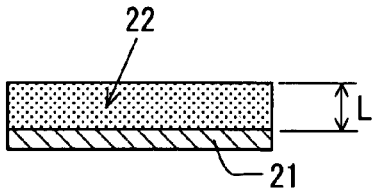
FIG. 8B is a schematic cross-sectional view of the adsorbent filled layer for explaining the thickness L according to the first embodiment.

FIG. 8A shows a characteristic of the adsorption speed ($\eta/\tau$) of the adsorbent filled layer having different thickness L, such as 1 mm, 2 mm, and 4 mm. In FIG. 8A, a horizontal axis represents a time $\tau$ of adsorption, and a vertical axis represents an adsorptive efficiency $\eta$. As shown in FIG. 8A, the adsorption speed reduces as the thickness L increases. That is, the thinner adsorbent filled layer has the faster adsorption speed. FIG. 8B shows the adsorbent filled layer for explaining the thickness L.

Figure 7B:
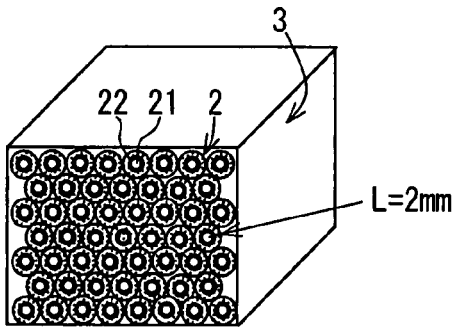
FIGS. 7B and 7C are schematic views of the adsorbent filled layer per unit volume when the thickness L is 2 mm and 6 mm, respectively, according to the first embodiment.
Figure 7C:
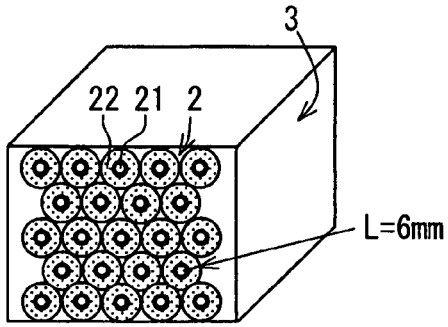

FIG. 7B shows an example of the adsorbent filled layer of a unit volume when the thickness L is 2 mm, and FIG. 7C shows another example of the adsorbent filled layer of a unit volume when the thickness L is 6 mm. As shown in FIGS. 7B and 7C, the bulk of the heat medium pipes 21 reduces with the increase of the thickness L. Therefore, the volume of the adsorbent 24 contained in the adsorbent filled layer increases as the thickness L increases. However, as shown in FIG. 8A, the adsorbent speed ($\eta/\tau$) is slow. Therefore, the cooling capacity reduces as the thickness L increases more than some amount.

The refrigerating capacity is in proportional to the weight of the adsorbent and the adsorption speed ($\eta/\tau$). When the thickness L is 2 mm, the cooling efficiency per unit volume is at the maximum, as shown in FIG. 7A.

Further, as shown in FIG. 7A, it is preferable that the thickness L is in a range between equal to or greater than 0.5 mm and equal to or less than 6 mm. When the thickness L is in the range, the condition of the adsorbent filled layer is satisfied while allowing difference between the heat transferring distance r1 and the osmotic distance r2.

Even when the heat transferring distance r1 and the osmotic distance r2 are different in the range, the cooling efficiency equal to or greater than 70% of the maximum cooling efficiency is provided. Accordingly, the adsorption module 1 having a sufficient heat transferring characteristic and having a reduced diffusion resistance of the adsorbed medium is provided.

Further, it is studied about the condition that the thickness L is in the range of 0.5 mm and 6.0 mm, and it is found that an allowable difference between the osmotic distance r2 and the heat transferring distance r1 is approximately 2 mm when the thickness L of the adsorption filled layer is in the above range. In other words, when the thickness L, that is, the heat transferring distance r1 and osmotic distance r2 satisfy the above conditions, the cooling efficiency of 70% or more is provided. Thus, the adsorbent filled layer provides a sufficient cooling efficiency.

The ranges of the heat transferring distance r1 and the osmotic distance r2 may be further limited to the following ranges to further improve the cooling efficiency.

For example, the heat transferring distance r1 and the osmotic distance r2 are set in the range between 0.8 mm and 4.8 mm. In this case, the adsorbent filled layer provides the cooling efficiency of 80% or more relative to the maximum cooling efficiency. Thus, the cooling efficiency further improves.

Further, the heat transferring distance r1 and the osmotic distance r2 are set in the range between 1.5 mm and 3.8 mm. In this case, the adsorbent filled layer provides the cooling efficiency of 90% or more relative to the maximum cooling efficiency.

Referring back to FIGS. 1 to 3, the casing 3 is made of a metal such as copper or copper alloy. The casing 3 includes a casing body 31, sheets 32, 33 and tanks 34, 35.

The casing body 31 has a cylindrical shape and forms a space for housing the cylindrical porous heat transferring member 23 of the adsorption heat exchanging part 2 therein. A lower opening 32 and an upper opening 33 can be sealed by the sheets 32, 33, respectively, so that the space of the casing body 31 is maintained in a vacuum condition.

The casing 3 has an adsorbed medium inlet pipe 36 and an adsorbed medium outlet pipe 37 adjacent to an upper end of the casing body 31 for introducing and discharging the vapor into and from the porous heat transferring member 23 housed in the casing body 31. In the closed space of the casing body 31, other gas (e.g., a gas-phase refrigerant) except for the adsorbed medium (vapor) does not exist.

During the adsorption, the vapor, which flows from the evaporator, flows in the casing body 31 through the adsorbed medium inlet pipe 36, as shown by the arrow A1. The vapor is separated into the adsorbed medium passages 25 and enters the adsorbent filled layers. During the desorption, the vapor is discharged from the adsorbent filled layers into the adsorbed medium passages 25. The desorbed vapor passes through the adsorbed medium passages 25 and flows out from the casing body 31 through the adsorbed medium outlet pipe 37 toward the condenser, as shown by the arrow A2.

As shown in FIG. 3, the sheets 32, 33 are formed with through holes 32*a*, 33*a* for allowing the heat medium pipes 21 to pass through. The sheets 32, 33 are air-tightly bonded with the heat medium pipes 21 such as by brazing, in a condition that the heat medium pipes 21 pass through the through holes 32*a*, 33*a*.

The tanks 34, 35 are coupled to the lower and upper ends of the casing body 31. The tanks 34, 35 are provided with a heat medium inlet pipe 38 and a heat medium outlet pipe 39, respectively. Thus, the heat exchange medium flows in the lower tank 34 from the heat medium inlet pipe 38, as shown in FIG. B1. The heat exchange medium flows through the heat medium pipes 21, as shown in FIG. 4B, and flows further into the upper tank 35. Then, the heat exchange medium flows out from the upper tank 35 through the heat medium outlet pipe 39, as shown by an arrow B2 in FIG. 3.

That is, the tank 34 is provided to distribute the heat exchange medium into the heat medium pipes 21, and the tank 35 is provided to collect the heat exchange medium having passed through the heat medium pipes 21 therein. In the example shown in FIGS. 1 to 3, the casing body 31 and the heat medium pipes 21 have circular shaped cross-sections. However, the cross-sectional shapes of the casing body 31 and the heat medium pipes 21 are not limited to the illustrated shapes. For example, the casing body 31 and the heat medium pipes 21 may have elliptical or rectangular-shaped cross-sections.

Figure 9:
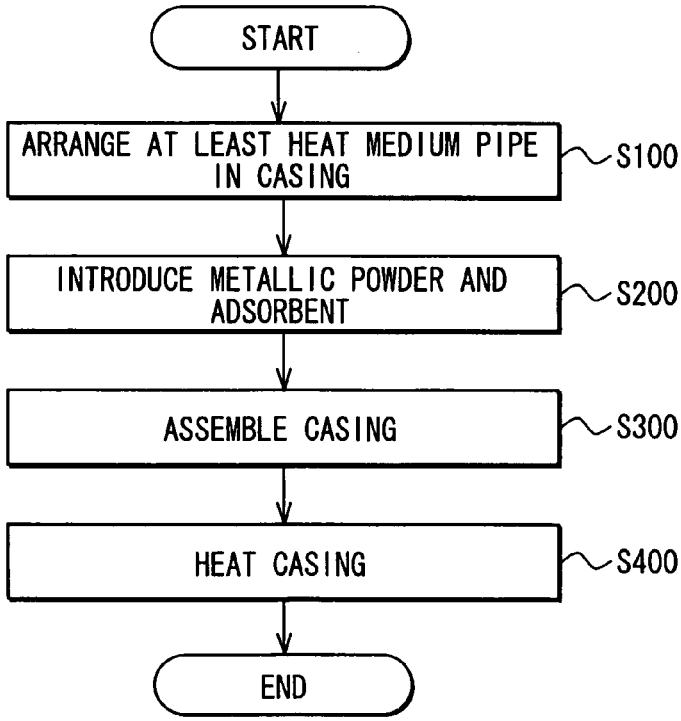
FIG. 9 is a flow chart for showing an example of a process of manufacturing the adsorption module according to the first embodiment.

Next, a process of manufacturing the adsorption module 1 will be described with reference to FIG. 9. In the manufacturing process, at a step S100, the component parts at least including the heat medium pipes 21 are arranged in the casing 3. At a step S200, the metallic powder 23*b* such as the copper powder and the adsorbent 24 are introduced in the casing 3 through an opening (hereafter, introduction port). At a step S300, the introduction port is closed, and the casing 3 is assembled, that is, component parts of the casing 3 to be brazed are all assembled. Then, at a step S400, the assembled casing 3 is heated in a brazing furnace.

Here, the step S100 is performed as a pre-step of the introducing step S200. The component parts are assembled to the casing 3 as much as possible before the copper powder 23*b* and the adsorbent 24 are introduced in the casing 3.

In the step S100, the heat medium pipes 21 are held and fixed in the casing 3. Specifically, first, ends of the heat medium pipes 21 are inserted in the through holes 32*a* of the sheet 32. In this condition, the heat medium pipes 21 are expanded in diameter, so that the heat medium pipes 21 are fixed to the sheet 32. Next, the sheet 32 is fixed to the lower opening of the casing body 31. In this condition, the upper opening of the casing body 31 is not covered, but the heat medium pipes 21 are held and fixed in the casing body 31.

Also in this condition, the adjacent heat medium pipes 21 are arranged at predetermined intervals in the casing body 31. Namely, clearances for forming the peripheral portions 22 are maintained between the adjacent heat medium pipes 21.

Also, in the step S100, jigs 61 for forming the adsorbed medium passages 25 (hereafter, referred to as the passage-forming jigs 61) are inserted between the heat medium pipes 21 in the casing body 31. The passage-forming jigs 61 are used for forming spaces (holes) as the adsorbed medium passages 25 in the porous heat transferring member 23, that is, in the peripheral portions 22.

Figure 10:
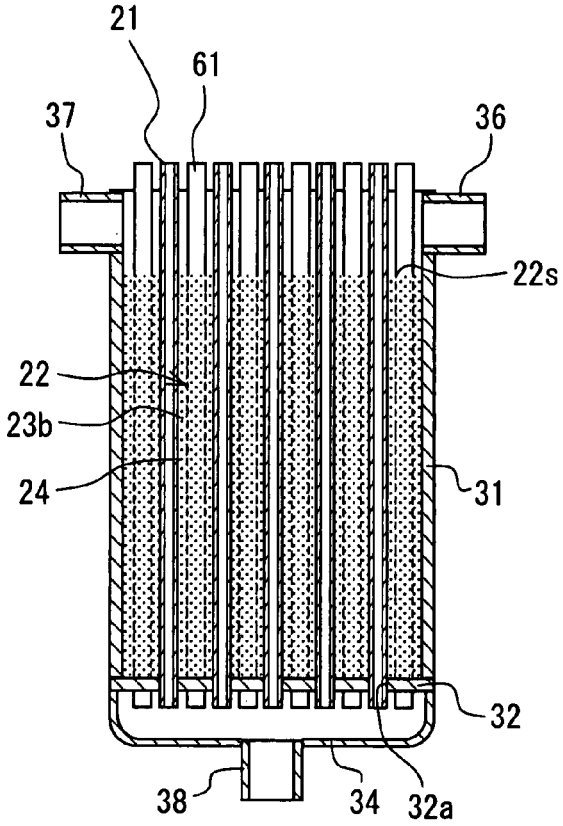
FIG. 10 is a schematic cross-sectional view of the adsorption module for showing an example of an introducing step of the process according to the first embodiment.

For example, the passage-forming jigs 61 have straight rod shapes, as shown in FIG. 10. The timing of inserting the passage-forming jigs 61 in the casing 3 is not limited to the step S100. The passage-forming jigs 61 may be assembled in the casing 3 in the step S200. In the case that the passage-forming jigs 61 are inserted in the casing 3 in the step S200, the passage-forming jigs 61 are inserted between the heat medium pipes 21 before the copper powders 23*b* and the adsorbent 24 are introduced in the casing 3.

Next, in the step S200, the copper powder 23*b* and the adsorbent 24 are introduced in the peripheral areas of the heat medium pipes 21 and the passage-forming jigs 61 within the casing body 31. Specifically, the mixture of the copper powder 23*b* and the adsorbent 24 is introduced in the casing body 31 through the introduction port such as the upper opening of the casing body 31 to which the sheet 33 is not assembled yet or communication holes of the casing body 31 to which the adsorbed medium inlet and outlet ports 36, 37 are coupled. As shown in FIGS. 2 and 10, the casing body 31, that is, the peripheral areas of the heat medium pipes 21 and the passage-forming jigs 61 are filled with a predetermined amount of the mixture of the copper powder 23*b* and the adsorbent 24.

Then, the passage-forming jigs 61 are removed from the casing body 31. Therefore, the spaces for the adsorbed medium passages 25 are formed in the mixture of the copper powder 23*b* and the adsorbent 24.

Figure 11:
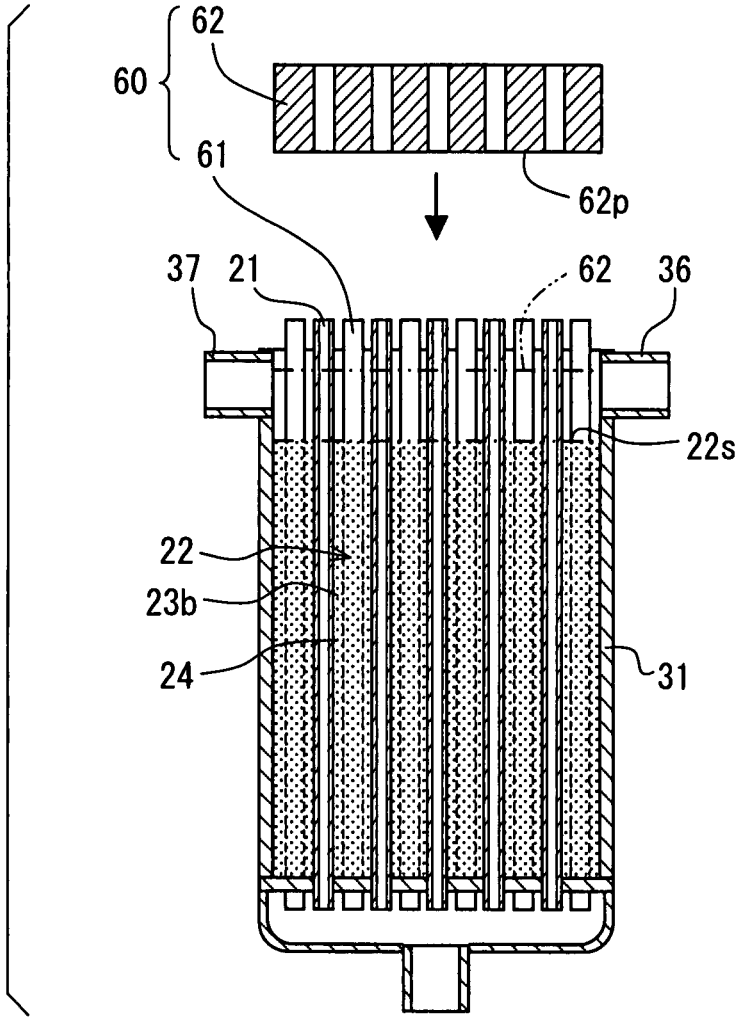
FIG. 11 is a schematic cross-sectional view of the adsorption module for showing an example of a pressing step according to the first embodiment.

In the step S200, for example, the mixture of the copper powders 23*b* and the adsorbent 24 in the casing body 31 is compacted to be solid before the passage-forming jigs 61 are removed. For example, as shown in FIG. 11, a top surface 22*s* of the mixture of the copper powder 23*b* and the adsorbent 24 in the casing body 31 is pressed by a pressing jig 62, so that the copper powders 23*b* and the adsorbent 24 are compacted.

Accordingly, the spaces for the adsorbed medium passages 25 are maintained in the compacted copper powder 23*b* and adsorbent 24 even after the passage-forming jigs 61 are removed.

Figure 12A:
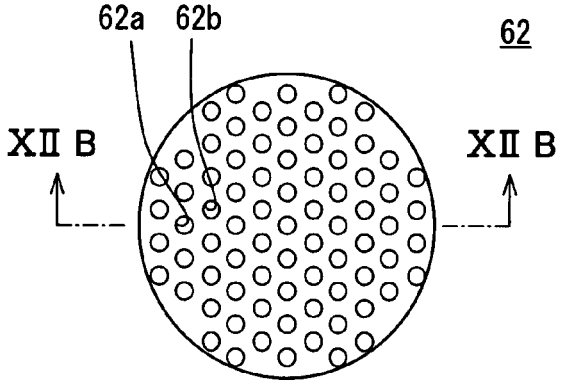
FIG. 12A is a plan view of a pressing jig used in the pressing step shown in FIG. 11.
Figure 12B:
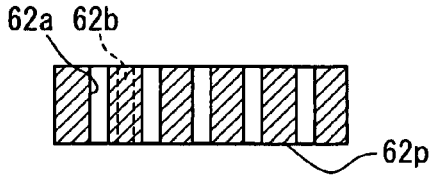
FIG. 12B is a cross-sectional view of the pressing jig taken along a line XII-XII in FIG. 12A.

FIGS. 12A and 12B shows an example of a jig unit 60 including the pressing jig 62 and the passage-forming jigs 61. The pressing jig 62 shown in FIGS. 12A and 12B has a cylindrical shape, and is capable of being inserted in the casing 3. The pressing jig 62 has an end surface 62*p* for applying a force to the surface 22*s* of the mixed copper powder 23*b* and adsorbent 24 in the casing body 31. The pressing jig 62 is formed with insertion holes 62*a*, 62*b* for allowing the heat medium pipes 21 and the passage-forming jigs 61 to pass through, respectively.

For example, the pressing jig 62 is inserted in the casing body 31 such that the heat medium pipes 21 and the passage-forming jigs 61 pass through the insertion holes 62*a*, 62*b*. The surface 22*s* of the mixed copper powder 23*b* and adsorbent 24 is pressed by the end surface 62*p* of the pressing jig 62.

The method of forming the adsorbed medium passages 25 is not limited to the above method. For example, the adsorbed medium passages 25 may be formed by the following method using a jig unit 160 shown in FIGS. 13A and 13B.

For example, the adsorbed medium passages 25 can be formed at the same time as pressing the surface 22*s* of the mixed copper powder 23*b* and adsorbent 24. The jig unit 160 includes a pressing part 162 and passage-forming rods 161 extending from the pressing part 162. The passage-forming rods 161 extends straight and has projections (e.g., sharp ends) 161*a* at the ends thereof. The passage-forming rods 161 are integrated with the pressing part 162. The pressing part 162 is formed with insertion holes 62*a* for allowing the heat medium pipes 21 to pass through.

After the mixture of the copper powders 23*b* and the adsorbent 24 is filled in the casing body 31, the surface 22*s* of the mixture of the metallic powder 23*b* and adsorbent 24 is pressed by a pressing surface 62*p* of the pressing part 162. Since the passage-forming rods 161 are integrated with the pressing part 162, the spaces for the adsorbed medium passages 25 are formed at the same time as pressing the top surface 22*s*. Thus, when the jig unit 160 is removed, the spaces for the adsorbed medium passages 25 appear in the compacted mixture of the metallic powder 23*b* and adsorbent 24.

Figure 13A:
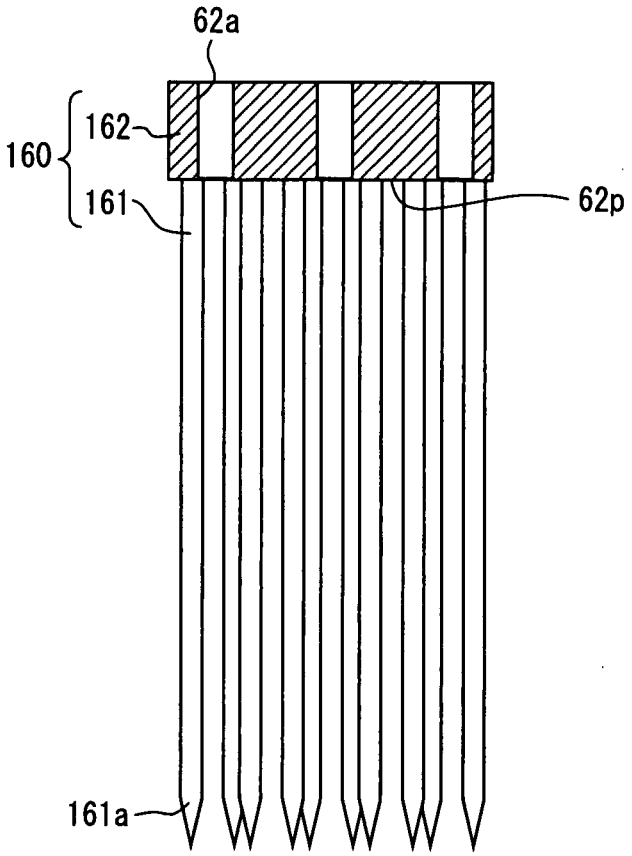
FIG. 13A is a schematic cross-sectional view of a pressing jig used in another example of a pressing step of the process according to the first embodiment.
Figure 13B:
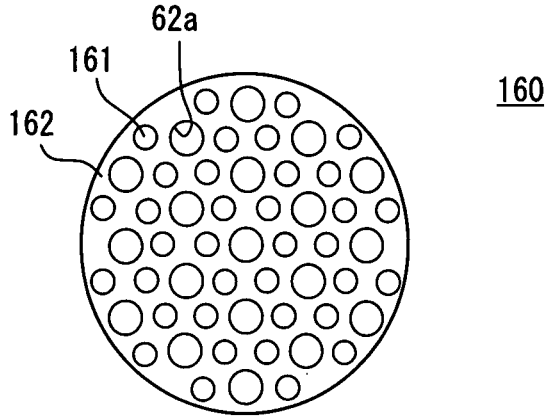
FIG. 13B is a bottom view of the pressing jig shown in FIG. 13A when viewed from the bottom.
Figure 14A:
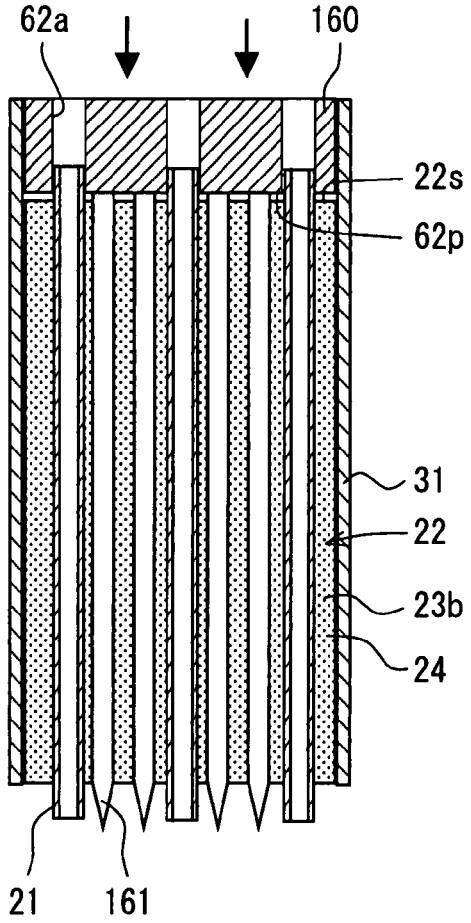
FIG. 14A is an explanatory cross-sectional view for showing the pressing step using the pressing jig shown in FIGS. 13A and 13B according to the first embodiment.
Figure 14B:
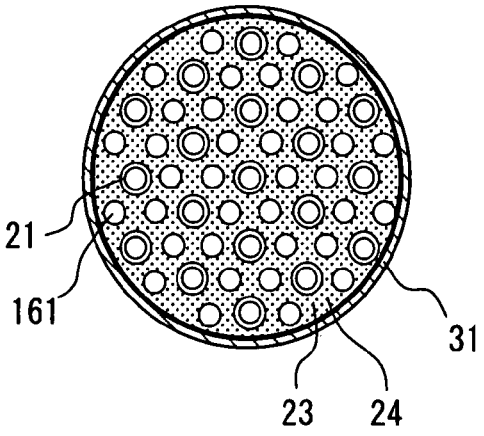
FIG. 14B is a schematic cross-sectional view of the adsorption module in the pressing step shown in FIG. 14A

Accordingly, in the method using the jig unit 160 shown in FIGS. 13A and 13B, the steps of the manufacturing process are reduced, as compared with the method using the jig unit 60 shown in FIGS. 12A and 12B.

Next, in the step S300, all of other component parts to be brazed are assembled to the casing 3. For example, the sheet 33 is assembled to the upper opening of the casing body 31. The adsorbed medium inlet pipe 36 and the adsorbed medium outlet pipe 37 are coupled to the communication holes of the casing body 31, respectively.

Further, the tanks 34, 35 are assembled to the sheets 32, 33 or the casing body 31. Also, the heat medium inlet pipe 38 and the heat medium outlet pipe 39 are coupled to the tanks 34, 35, respectively.

In the step S400, all of the assembled components parts are brazed, the copper powder 23*b* is sintered so that the porous heat transferring member 23 is formed, the porous heat transferring member 23 is bonded to the heat medium pipes 21 by sintering, and the adsorbent 24 is fixed in the porous heat transferring member 23.

Specifically, a brazing material is applied to the component parts to be brazed, first. For example, the brazing material is applied to connecting portions between the sheets 32, 33 and the heat medium pipes 21, connecting portions between the sheets 32, 33 and the casing body 31, and connecting portions between the sheets 32, 33 and the tanks 34, 35.

Alternatively, the component parts such as the sheets 32, 33 and the tanks 34, 35 can be prepared by copper members that are cladded with a brazing material. In this case, it is not necessary to apply the brazing material to the respective connecting portions of the assembled component parts.

A sintering temperature of the copper powder 23*b* is in a range between equal to or greater than 700° C. and equal to or less than 1000°. Therefore, a material having a melting temperature in the range between equal to or greater than 700° C. and equal to or less than 1000° is employed as the brazing material. For example, the brazing material is a copper material or a silver material. Further, an adsorbent that is not broken under the high temperature condition in the furnace (e.g., more than 700° C.) is employed as the adsorbent 24.

In this embodiment, the porous heat transferring member 23 is formed with the adsorbed medium passages 25 in addition to the three-dimensional mesh-like small holes 23*a*. The adsorbed medium passages 25 are located between the heat medium pipes 21 and extend parallel to the axes of the heat medium pipes 21. As such, the vapor easily osmoses from the adsorbed medium passages 25 into the adsorbent filled layers and are adsorbed by the adsorbent 24 contained in the pores 23*a* of the porous heat transferring member 23. Accordingly, the adsorption speed improves.

Further, the adsorbed medium passages 25 and the heat medium pipes 21 are arranged such that the osmotic distance r2 is substantially uniform throughout the length of the heat medium pipes 21. Since the adsorbed medium passages 25 are formed between the heat medium pipes 21, the diffusion resistance of the vapor reduces. As such, the adsorption speed and the desorption speed improve.

In the first embodiment, the vapor enters the porous heat transferring member 23 from one end (upper end in FIG. 3). Even in this case, the vapor is smoothly diffused from the upper end toward the lower end through the adsorbed medium passages 25. That is, the vapor is smoothly diffused over the porous heat transferring member 23 through the adsorbed medium passages 25. The vapor easily reaches the lower portion of the porous heat transferring member 23 and the adsorbent 24 contained in the lower portion of the porous heat transferring member 23. Accordingly, the diffusion resistance of the vapor effectively reduces.

Further, the adsorbed medium passages 25 and the heat medium pipes 21 are arranged such that each of the heat transferring distance r1 and the osmotic distance r2 is in the range between equal to or greater than 0.5 mm and equal to or less than 6 mm. Even the heat transferring distance r1 and the osmotic distance r2 are different, the cooling efficiency of 70% or more is provided as long as the heat transferring distance r1 and the osmotic distance r2 are respectively in the above range. Accordingly, the heat transferring characteristic improves, and the diffusion resistance of the adsorbed medium reduces.

Further, when each of the heat transferring distance r1 and the osmotic distance r2 is in the range between 0.8 mm and 4.8 mm, the cooling efficiency further improves (e.g., 80% or more). Furthermore, when each of the heat transferring distance r1 and the osmotic distance r2 is in the range between 0.5 mm and 6 mm, the cooling efficiency further improves (e.g., 90% or more).

In the porous heat transferring member 23, the adsorbed medium passages 25 extend parallel to the heat medium pipes 21. The vapor can flow in the adsorbed medium passages 25 in one direction. Therefore, the adsorbed medium passages 25 are easily arranged between the heat medium pipes 21 such that the heat transferring distance r1 and the osmotic distance r2, which affect the adsorption and desorption speeds, are equal as much as possible.

Further, the adsorbed medium passages 25 extend straight along the axes of the heat medium pipes 21. Therefore, the adsorbed medium passages 25 are easily formed by using the straight jigs 61. That is, the adsorbed medium passages 25 are formed by placing the straight rods 61 in a space for forming the porous heat transferring member 23 and removing the straight rods 61 from the space after the copper powder 23*b* and the adsorbent 24 are introduced in the space.

In the adsorption module 1, the porous heat transferring member 23 is housed in the casing 3, the adsorbed medium inlet pipe 36 is in communication with the evaporator, and the adsorbed medium outlet pipe 37 is in communication with the condenser. During the adsorption, the vapor is introduced into the adsorbent filled layers of the porous heat transferring member 23 from the evaporator. During the desorption, the vapor is discharged from the adsorbent filled layers and introduced into the condenser. Therefore, energy loss during the adsorption and the desorption in the evaporator and the condenser is reduced, even when the evaporator and the condenser are provided separately from the casing 3.

The porous heat transferring member 23 is provided by the sintered body that is formed by sintering of the metallic powder 23*b* such as the copper powder or the copper alloy powder. The heat medium pipes 21 are made of copper or copper alloy.

Since the heat medium pipes 21 exist in the metallic powders 23*b* during the sintering, the porous heat transferring member 23, which have the high heat transferring characteristic, are bonded to the heat medium pipes 21 by the sintering. That is, the porous heat transferring member 23 and the heat medium pipes 21 are connected by metallic bonding, not by simply contacting. Therefore, the heat transferring efficiency improves.

In the method of manufacturing the adsorption module 1, the component parts at least including the heat medium pipes 21 and the passage-forming jigs 61 are arranged in the casing 3. Then, the metallic powder 23*b* and the adsorbent 24 are mixed and introduced in the casing 3 such that the mixture of the metallic powder 23*b* and the adsorbent 24 is placed on the peripheral areas of the heat medium pipes 21. Thereafter, the passage-forming jigs 61 are removed so that the spaces for the adsorbed medium passages 25 are formed in the mixture of the metallic powder 23*b* and the adsorbent 24 in the casing 3.

Further, all of the other component parts to be brazed are assembled, and the introduction port is closed. The assembled casing 3 is heated in the furnace. Accordingly, the metallic powders 23*b* are sintered so that the porous heat transferring member 23 is formed, and the heat medium pipes 21 and the casing 3 are brazed.

Namely, in the method, the sintering for sintering the metallic powders 23*b* on the peripheral portions 22 of the heat medium pipes 21, a setting for setting the adsorbent 24 in a condition that the adsorbent 24 can have adsorptive activity, and the brazing for brazing the component parts are all performed in the heating step. Therefore, the number of steps of the manufacturing process reduces.

To form the adsorbed medium passages 25, the passage-forming jigs 61 are arranged in the space where the porous heat transferring member 23 is to be formed, with the heat medium pipes 21. The passage-forming jigs 61 are removed after the metallic powder 23*b* and the adsorbent 24 are introduced in the space. Accordingly, the spaces for the adsorbed medium passages 25 are easily formed. Since the adsorbed medium passages 25 are integrally formed into the porous heat transferring member 23, the manufacturing process is simplified, and costs for manufacturing the adsorption module 1 reduces.

In this method, the surface 22*s* of the mixture of the metallic powder 23*b* and the adsorbent 24 in the casing body 31 can be pressed by the pressing jig 62, before the passage-forming jigs 61 are removed. Therefore, since the metallic powders 23*b* and the adsorbent 24 are compacted, the spaces of the adsorbed medium passages 25 remain even after the passage-forming jigs 61 are removed.

That is, even in a condition where the metallic powder 23*b* are not bonded by sintering yet, the metallic powder 23*b* and the adsorbent 24 in the casing 3 are solid and retain the shape. Even when the casing 3 filled with the metallic powder 23*b* and the adsorbent 24 is moved, that is, carried from one step to another step during the manufacturing, the compacted metallic powder 23*b* and adsorbent 24 withstands against an impact, which will be caused during the moving.

Further, the metallic powder 23*b* is abutted or pressed against the heat medium pipes 21 when the surface 22*s* is pressed by the pressing jig 62. That is, contact portions between the metallic powder 23*b* and the heat medium pipes 21 increase. Therefore, the metallic powder 23*b* is effectively bonded to the heat medium pipes 21 by sintering during the heating.

In the method using the jig unit 160, the spaces for the adsorbed medium passages 25 are formed at the same time as pressing the top surface 22*s*, after the metallic powder 23*b* and the adsorbent 24 are introduced in the casing 3. In the jig unit 160, the passage-forming rods 161 are integrated with the pressing part 162. After the metallic powders 23*b* and the adsorbent 24 are introduced in the casing body 31, the surface 22*s* of the metallic powder 23*b* and the adsorbent 24 is pressed by the end surface 62*p* of the pressing part 162 while inserting the passage-forming rods 161 into the metallic powder 23*b* and the adsorbent 24. Then, when the jig unit 160 is separated, that is, the passage-forming rods 161 are removed from the casing body 31, the spaces for the adsorbed medium passages 25 remain in the compacted metallic powder 23*b* and adsorbent 24.

In other words, the step of forming the space for the adsorbed medium passages 25 and the step of pressing the surface 22*s* are performed at once. Therefore, the number of steps in the manufacturing process reduces. Further, the passage-forming rods 161 have the sharp ends 161*a*. Therefore, the passage-forming rods 161 are smoothly inserted into and removed from the metallic powder 23*b* and adsorbent 24.

Further, the brazing material having the melting point in the range between 700° C. and 1000° C. is used. The sintering temperature of the copper powders 23*b* is also in the range between 700° C. and 1000° C. Therefore, the brazing step and the sintering step are performed at the same time only by heating the casing 3 in the furnace.

Second Embodiment

Figure 15A:
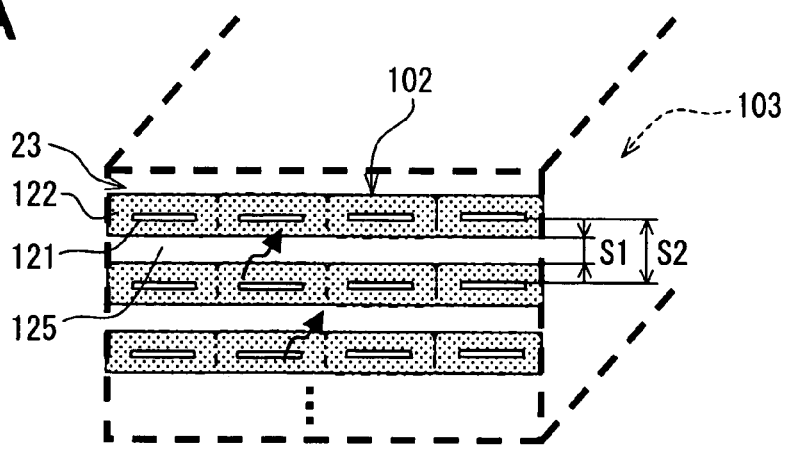
FIG. 15A is a schematic cross-sectional view of a heat exchanging part of an adsorption module according to a second embodiment of the present invention.
Figure 15B:
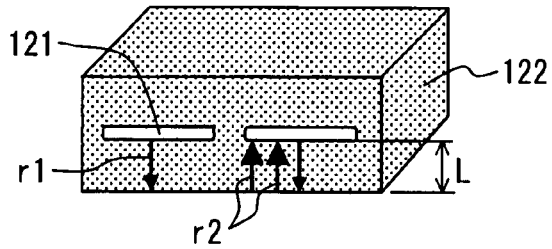
FIG. 15B is a partial enlarged view of the heat exchanging part shown in FIG. 15A.

A second embodiment will be described with reference to FIGS. 15A and 15B. In the second embodiment, the adsorption module 1 has an adsorption heat exchanging part 102, which includes flat heat medium pipes 121, in a casing 103 as shown in FIG. 15A.

The porous heat transferring member 23 includes the adsorbent filled layers, that is, the peripheral portions 122. The peripheral portions 122 extend in the right and left direction of FIG. 15A and are arranged in the up and down direction in FIG. 15A at predetermined intervals. The flat heat medium pipes 121 are aligned in each peripheral portion 122 at predetermined intervals. In a cross-section defined in a direction perpendicular to the axis of the adsorption heat exchanger 102, longitudinal sides of the flat heat medium pipes 121 are parallel to a longitudinal side of the peripheral portion 122.

The adsorbed medium passage 125 is formed between the peripheral portions 122. The adsorbed medium passage 125 also has a flat shape parallel to the flat heat medium pipes 121. In other words, the adsorbed medium passages 125 and the peripheral portions 122 are alternately arranged in the up and down direction in FIG. 15A.

In this case, the heat is mainly transferred from main surfaces of the heat medium pipes 121, that is, from the longitudinal side in its cross-sectional shape. Therefore, the heat transferring distance r1 and the osmotic distance r2 are defined as shown in FIG. 15B. That is, the heat transferring distance r1 is defined by a half of a distance that is obtained by subtracting a thickness (S1) of the adsorbed medium passage 125 from a distance (S2) between main surfaces of the adjacent heat medium pipes 121. (r1=(S2−S1)/2) Also, the osmotic distance r2 is defined by a distance from the adsorbed medium passage 125 to the outer surface of the main surface of the heat medium pipe 121.

In this case, the heat transferring distance r1 and the osmotic distance r2 are normally substantially equal. Even when the heat medium pipes 121 have the flat shapes, the heat is mainly transferred from the main surfaces of the flat heat medium pipes 121. The similar effects as the first embodiment will be provided.

Since the heat transferring distance r1 and the osmotic distance r2 are substantially equal, even when the thickness L of the adsorbent filled layer needs to be set in a range smaller than the range of the first embodiment, the heat transferring distance r1 and the osmotic distance r2 are easily set. Therefore, the cooling efficiency of a substantially maximum level or close to the maximum level is provided. As such, the performance of the adsorption module 1 further improves.

Also, since the adsorbed medium passages 125 are parallel to the flat medium pipes 121, the adsorption module 1 having the adsorption heat exchanging part 102 may be formed by the similar manner as the first embodiment.

Third Embodiment

Figure 16A:
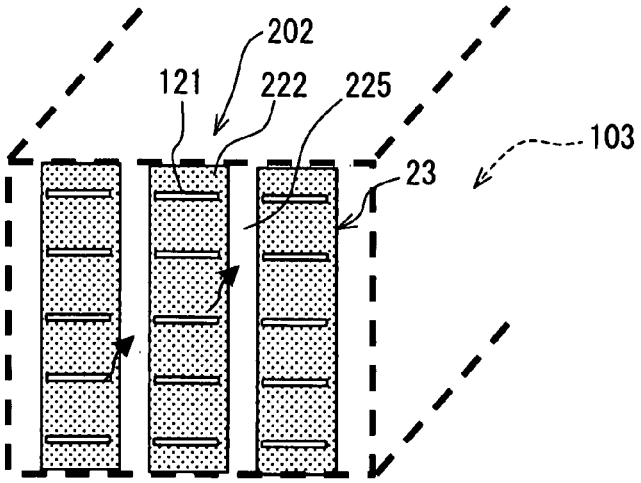
FIG. 16A is a schematic cross-sectional view of a heat exchanging part of an adsorption module according to a third embodiment of the present invention.

A third embodiment of the present invention will be described with reference to FIGS. 16A and 16B. In the third embodiment, the adsorption module 1 has an adsorption heat exchanging part 202 shown in FIG. 16A.

The heat exchanging part 202 includes the porous heat transferring member 23 that has adsorbent filled layers, that is, peripheral portions 222. The peripheral portions 222 are arranged at predetermined intervals in the right and left direction in FIG. 16A. The peripheral portions 222 extend in the up and down direction in FIG. 16A. The flat medium pipes 121 are arranged in a row in each peripheral portion 222. The flat medium pipes 121 are arranged such that the main surfaces of the adjacent heat medium pipes 121 are opposed to each other in the peripheral portion 222.

Further, adsorbed medium passages 225 are formed between the peripheral portions 222. In other words, the peripheral portions 222 and the adsorbed medium passages 225 are alternately arranged in the right and left direction in FIG. 16A. Each adsorbed medium passage 225 has a flat shape extending in the up and down direction in FIG. 16A, that is, in a direction perpendicular to the main surfaces of the heat medium pipes 121.

Figure 16B:
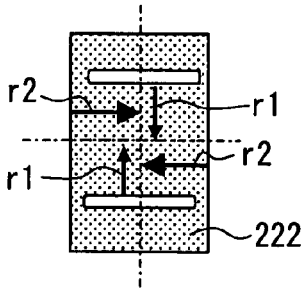
FIG. 16B is a partial enlarged view of the heat exchanging part shown in FIG. 16A.

The heat transferring distance r1 and the osmotic distance r2 are defined as shown in FIG. 16B. In this case, for example, the heat medium pipes 121 are arranged such that a distance between the main surfaces of the adjacent heat medium pipes 121 in the peripheral portion 222 is equal to a width of the peripheral portion. As such, the heat transferring distance r1 and the osmotic distance r2 are substantially equal. Accordingly, the similar effects as the second embodiment will be provided.

Also, in a case that the heat transferring distance r1 and the osmotic distance r2 have a difference between them, the heat transferring distance r1 and the osmotic distance r2 are set such that the thickness L of the adsorbent filled layer satisfies the range of the first embodiment.

Also in this embodiment, since the adsorbed medium passages 225 extend parallel to axes of the heat medium pipes 121, the similar effects as the first and second embodiment will be provided. The adsorption module 1 having the adsorption heat exchanging part 202 may be formed by the similar manner as the first and second embodiments.

Fourth Embodiment

Figure 17A:
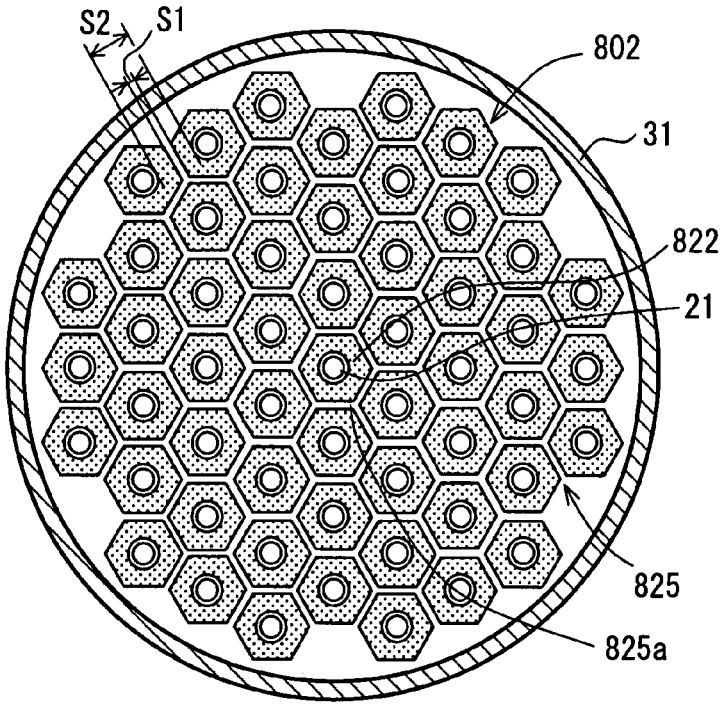
FIG. 17A is a cross-sectional view of an adsorption module according to a fourth embodiment of the present invention.

A fourth embodiment will be described with reference to FIGS. 17A through 20B. In the fourth embodiment, the adsorption module 1 has an adsorption heat exchanging part 802 as shown in FIG. 17A. The adsorption heat exchanging part 802 includes the porous heat transferring member 23, the heat medium pipes 21 and an adsorbed medium passage 25.

The porous heat transferring member 23 includes peripheral portions 822 around the heat medium pipes 21. In FIG. 17A, that is, in a cross-section defined in a direction perpendicular to the axes of the heat medium pipes 21, the adsorbed medium passage 825 is formed to surround each peripheral portion 822 such as in an annular or polygonal shape. In other words, the adsorbed medium passage 825 includes a plurality of passage portions 825*a*, and each of which surrounds the peripheral portion 822.

The adsorbed medium passage 825 extends in a direction parallel to the axes of the heat medium pipes 21, and also extends in directions intersecting the axes of the heat medium pipes 21. Also, in the adsorbed medium passage 825, the adjacent passage portions 825*a* are in communication with each other.

In other words, the adsorbed medium passage 825 includes portions extending in the direction parallel to the axes of the heat medium pipes 21 and in the directions intersecting the axes of the heat medium pipes 21. As such, the vapor can be introduced not only in the direction parallel to the axes of the heat medium pipes 21 but also in the directions intersecting the axes of the heat medium pipes 21. Accordingly, the vapor can be more effectively diffused into the peripheral portions 822.

Also, since the adjacent passage portions 825*a* surrounding the peripheral portions 822 are in communication with each other, the vapor can be substantially uniformly introduced over the adsorbed medium passage 825.

Each passage portion 825*a* has the annular or polygonal shaped cross-section. In the example shown in FIG. 17A, the passage portion 825*a* has a hexagonal cross-sectional shape. As such, since each peripheral portion 822 is entirely surrounded by the passage portion 825*a*, the vapor is effectively diffused into the corresponding peripheral portion 822.

Since the adjacent passage portions 825*a* are in communication with each other, the adsorbed medium passage 825 has a honeycomb shape. In this case, since the passage area of the adsorbed medium passage 825, that is, a total surface area of the adsorbed medium passage 825 facing the peripheral portions 822 increases larger than a total passage area of the adsorbed medium passage that are formed separately as an individual straight passage. As such, the adsorption speed of the vapor further improves.

Figure 17B:
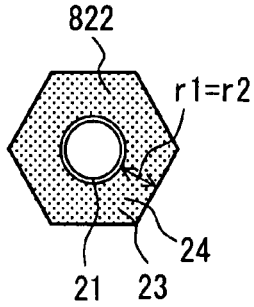
FIG. 17B is a cross-sectional view of a heat medium tube and a peripheral portion of a heat exchanging part of the adsorption module shown in FIG. 17A.

In the adsorption heat exchanging part 802, the heat transferring distance r1 and the osmotic distance r2 are defined as shown in FIG. 17B. That is, the heat transferring distance r1 is defined by a half of a distance that is obtained by subtracting a width (S1) of the passage portion 825*a* from a distance (S2) between outer surfaces of the adjacent heat medium pipes 21. The osmotic distance r2 is defined by a distance from an outer surface of the passage portion 825*a* to the outer surface of the heat medium pipe 21.

Further, the adsorbed medium passage 825 is formed to extend straight in the direction parallel to the axes of the heat medium pipes 21. That is, each passage portion 825*a* has an axis parallel to the axes of the heat medium pipes 21. Therefore, the adsorbed medium passage 825 is easily formed by using a passage-forming jig 261 shown in FIG. 18 and removing the jig 261 in one direction. Accordingly, even when the adsorbed medium passage 825 has the complex cross-sectional shape such as the honeycomb shape, it can be easily formed.

Figure 18:
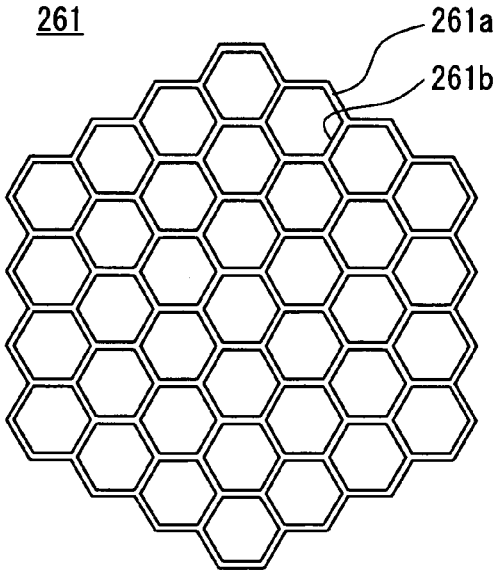
FIG. 18 is an end view of a passage-forming jig for forming an adsorbed medium passage used in a process of manufacturing the adsorption module according to the fourth embodiment.

Next, a method of manufacturing the adsorption module 1 having the adsorption heat exchanging part 802 will be described with reference to FIGS. 18 to 20B. First, at least the heat medium pipes 21 and the passage-forming jig 261 for forming the space for the adsorbed medium passage 825 are arranged in the casing 3. FIG. 18 shows an example of the passage-forming jig 261, and the passage-forming jig 261 has a length in a direction perpendicular to the paper of FIG. 18, that is, in a direction parallel to the axes of the heat medium pipes 21.

The passage-forming jig 261 has a honeycomb shape in a cross-section defined in a direction perpendicular to the length thereof. The passage-forming jig 261 includes honeycomb-shaped separation walls 261*a* for forming the peripheral portions 822. The inner surfaces 261*b* of the separation walls 261*a* form outer surfaces of the peripheral portions 822. The separation walls 261*a* form spaces for the adsorbed medium passage 825. The peripheral portions 822 are separated by the separation walls 261*a*.

Next, the metallic powder 23*b* and the adsorbent 24 are introduced in the casing 3. In this case, the surface 22*s* of the metallic powder 23*b* and adsorbent 24 in the casing 3 is separated into plural portions 882*s* by the separation walls 261*a*. That is, each portion 882*s* corresponds to a top portion of each peripheral portion 822. The adjacent portions 882*s* are separated from each other by the separation walls 261*a*.

Figure 19A:
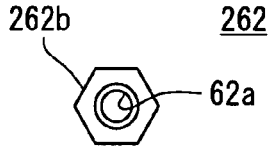
FIG. 19A is an end view of an example of a pressing jig used in the manufacturing process according to the fourth embodiment.
Figure 19B:
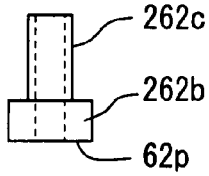
FIG. 19B is a side view of the pressing jig shown in FIG. 19A.

After the metallic powder 23*b* and the adsorbent 24 are introduced in the casing 3, the portions 882*s* are pressed by a pressing jig 262 shown in FIGS. 19A and 19B. Thereafter, the passage-forming jig 261 is removed from the compacted metallic powders 23*b* and adsorbent 24 so that the spaces for the adsorbed medium passage 825 is formed.

The pressing jig 262 shown in FIGS. 19A and 19B has a pressing portion 262*b* that includes a pressing end 62*p* for pressing the portion 822*s* and a guide portion 262*c* extending from the pressing portion 262*b*. The pressing jig 262 is formed with an insertion hole 62*a* throughout the pressing portion 262*b* and the guide portion 262*c* for allowing the heat medium pipe 21 to pass through. The pressing jig 262 has an outer shape corresponding to each peripheral portion 822, that is, corresponding to an inner shape of the separation wall 261. The pressing portion 262*b* and the guide portion 262*c* are integrated with each other.

Figure 20A:
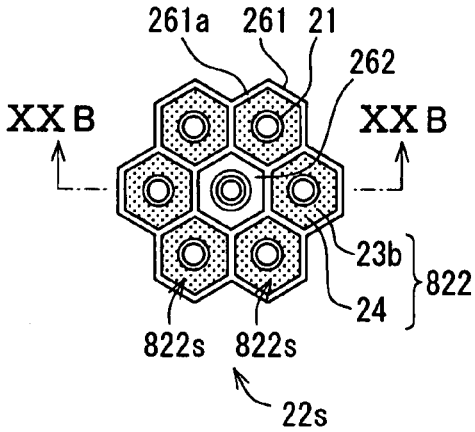
FIG. 20A is an explanatory view of an example of a pressing step of the manufacturing process using the pressing jig shown in FIGS. 19A and 19B according to the fourth embodiment.
Figure 20B:
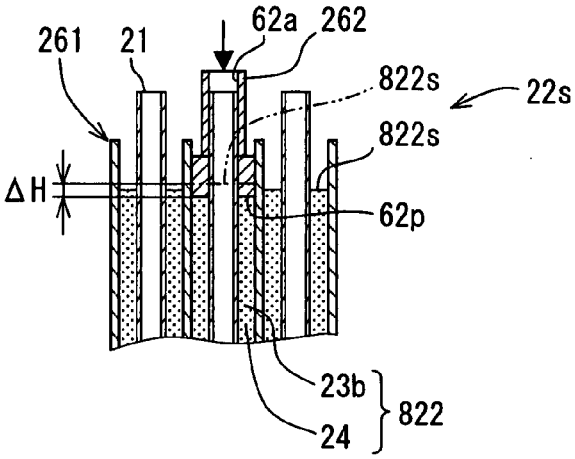
FIG. 20B is a cross-sectional view taken along a line XXB-XXB in FIG. 20A.

As shown in FIGS. 20A and 20B, each portion 822*s* is pressed by the pressing jig 262. For example, the plural portions 822*s* are sequentially pressed by the same pressing jig 262. Thus, all of the portions 822*s*, that is, the surface 22*s* is entirely pressed by the pressing jig 262. As another example, plural pressing jigs 262 are used so that all of the top portions 822*s* are pressed at once. Alternatively, the predetermined number of portions 822*s* are pressed by a corresponding number of pressing jigs 262.

In any cases, a pressing force to the portion 822*s* is adjusted by each of the pressing jig 262. That is, the pressing force is adjusted for each portion 822*s*. Therefore, the metallic powder 23*b* and adsorbent 24 in the peripheral portion 822 is uniformly compacted even by pressing the portion 822*s* thereof having a relatively small surface area.

As shown in FIG. 25B, AH represents a distance of the portion 822*s* pressed by the pressing jig 262. In this case, the pressing jig 262 has the shape corresponding to each of the peripheral portions 822. In other words, each of the portions 822*s* is pressed by the pressing jig 262. Therefore, it is not necessary to fill the peripheral portions 822 with the metallic powder 23*b* and adsorbent 24 such that the height of the portions 822*s* before the pressing is uniform. That is, even when the height of the portions 822*s* is not uniform after the metallic powder 23*b* and adsorbent 24 are introduced, the portions 822*s* can be uniform by individually pressing with the pressing jig 262.

In a case that the top surface 22*s* of the metallic powder 23*ba* and adsorbent 24 is pressed by one pressing jig 62 as in the first embodiment, it is preferable that the top surface 22*s* before the pressing is flat as much as possible. If the top surface 22*s* is not flat, only raised portions will be pressed, and the remaining portion will not be sufficiently pressed. That is, the top surface 22*s* will be pressed unevenly. Therefore, the metallic powders 23*b* and adsorbent 24 will be unevenly compacted.

In this embodiment, on the other hand, the top surface 22*s* is pressed by portion to portion, that is, the portions 822*s* are pressed independently by the pressing jig 262. Therefore, the portions 822*s* are compressed substantially uniformly over the top surface 22*s*, and the compressed metallic powder 23*b* and adsorbent 24 maintain the shape.

Also in this embodiment, the casing 3 is heated in the furnace after the jig 261 is removed.

Other Embodiments

The above embodiments will be modified in various ways. For example, the outer shapes of the heat medium pipes 21 and the casing 3 will not be limited to the cylindrical shape and the rectangular shape as described in the first to third embodiment. The heat medium pipe 21 may have any cross-sectional shape such as elliptical cross-section, polygonal cross-section or the like. Further, the casing 3 may have any cross-sectional shape such as elliptical cross-section, polygonal cross-section or the like.

Figure 21:
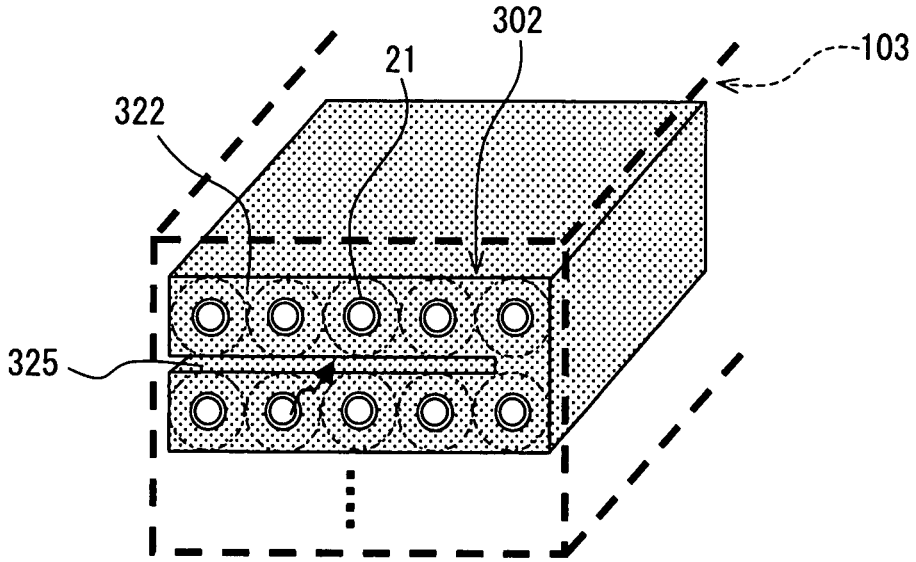
FIGS. 21 to 25 are schematic cross-sectional views of a heat exchanging part of an adsorption module according to other embodiments of the present invention.

In the first embodiment, the adsorbed medium passage 25 has a circular shaped cross-section. However, the adsorbed medium passage 25 may have any other cross-sectional shapes. FIG. 21 shows an example of the adsorption heat exchanging part. In the example shown in FIG. 21, an adsorption heat exchanging part 302 has a peripheral portion 322 that has a rectangular shaped cross-section, and the cylindrical heat medium pipes 21 are arranged in two rows in the peripheral portion 322. An adsorbed medium passage 325 is formed as a slit extending in the right and left direction of FIG. 21 between the rows of the heat medium pipes 21 in the peripheral portion 322.

Figure 22:
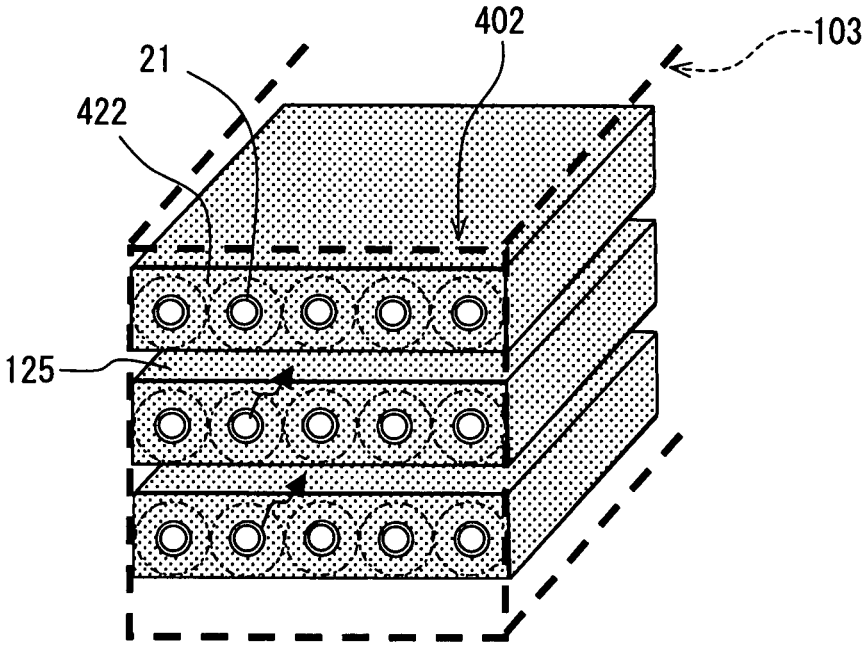

FIG. 22 shows another example of the adsorption heat exchanging part. In the example shown in FIG. 22, an adsorption heat exchanging part 402 has a rectangular-shaped cross-section. Each of peripheral portions 422 have a rectangular-shaped cross-section, and encloses a row of the heat medium pipes 21 having the cylindrical shape. The peripheral portions 422 are spaced from each other so that the adsorbed medium passages 125 are formed between them.

Figure 23:
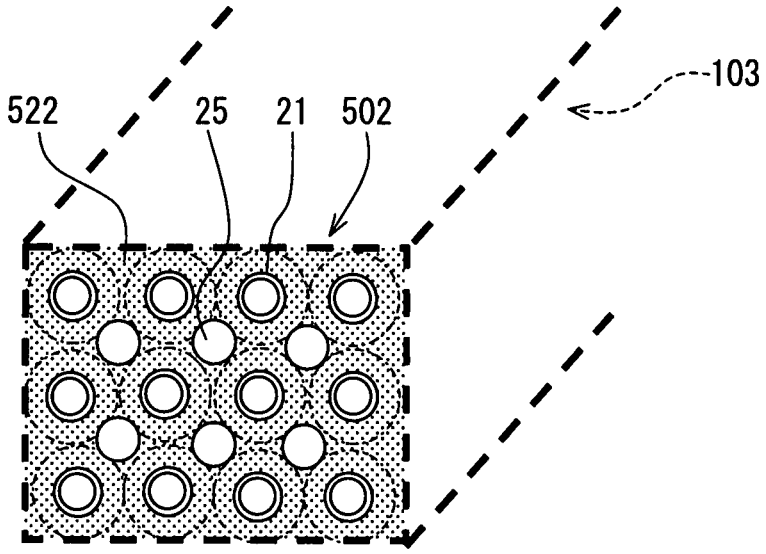

FIG. 23 shows another example of the adsorption heat exchanging part. In the example shown in FIG. 23, an adsorption heat exchanging part 502 includes peripheral portions 522 and the cylindrical heat medium pipes 21 surrounded in the peripheral portions 522. Each of the adsorbed medium passages 25 is arranged in an area surrounded by four heat medium pipes 21. As further another example, each of the adsorbed medium passages 25 may be arranged in an area surrounded by any number of the heat medium pipes 21, such as five, six or more.

Figure 24:
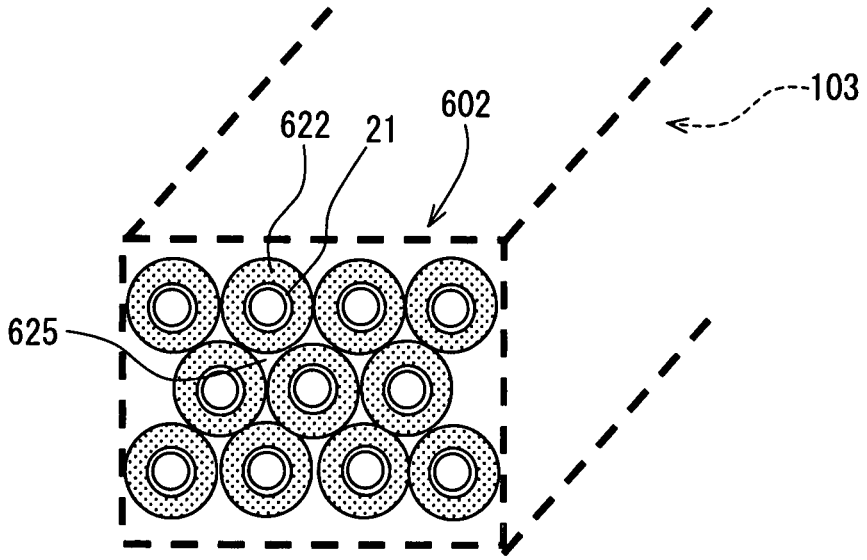

The cross-sectional shape of the adsorbed medium passage 25 will not be limited to the above discussed shapes. FIG. 24 shows another example of the adsorption heat exchanging part. In adsorption heat exchanging part 602 shown in FIG. 24, adsorbed medium passage 625 have a substantially triangular-shaped cross-section. In this case, the adsorbed medium passages 625 are easily arranged between the heat medium pipes 21 such that the heat transferring distance r1 and the osmotic distance r2 of peripheral portions 622 are substantially equal.

Figure 25:
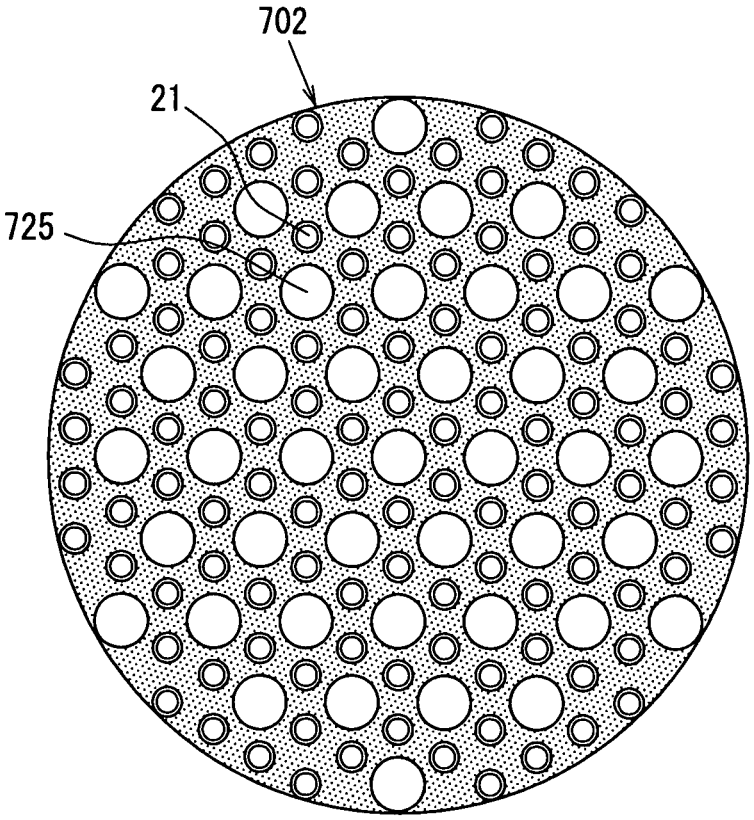

In the examples shown in FIGS. 5, 23, 25, each of the adsorbed medium passages 25, 725 is arranged in the area surrounded by the plural heat medium pipes 21. In such cases, an inner diameter of the adsorbed medium passage 25, 725 is not limited as long as the adsorbed medium such as the vapor is smoothly diffused into the adsorbent filled layers.

Figure 26A:
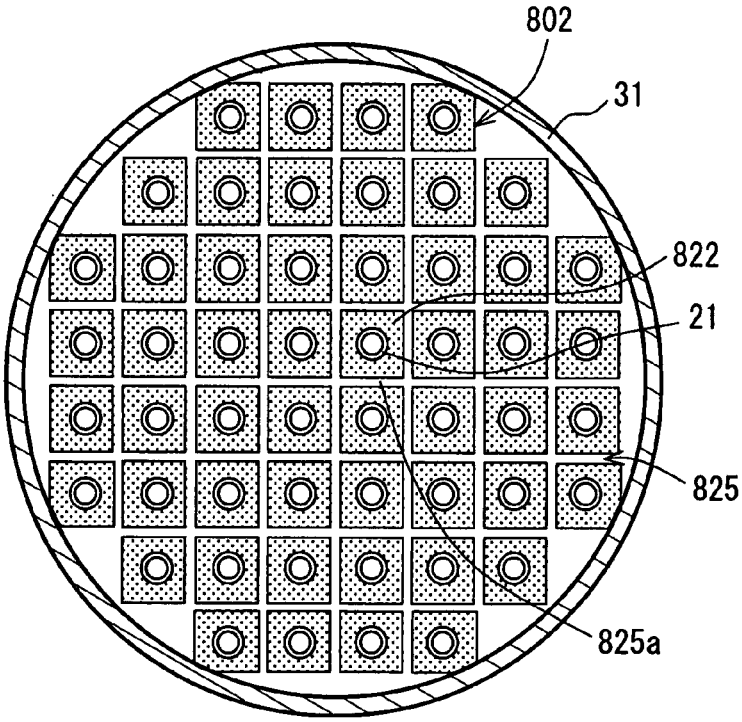
FIG. 26A is a cross-sectional view of an adsorption module according to further another embodiment of the present invention.
Figure 26B:
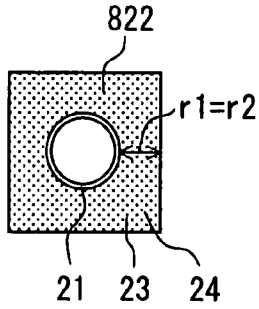
FIG. 26B is a partial enlarged view of the adsorption module shown in FIG. 26A.

In the fourth embodiment, the adsorbed medium passage 825 has the honeycomb shape forming hexagonal passage portions 825*a*. However, the shape of the adsorbed medium passage is not limited to the honeycomb shape forming the hexagonal passage portions 825*a* as long as the peripheral portions 822 are surrounded by the passage portions. For example, as shown in FIGS. 26A and 26B, the adsorbed medium passage 825 has a honeycomb shape in which the passage portions 825*a* have square or rectangular shaped cross-sections, or the passage portions 825*a* are formed in lattice-like pattern.

Figure 27A:
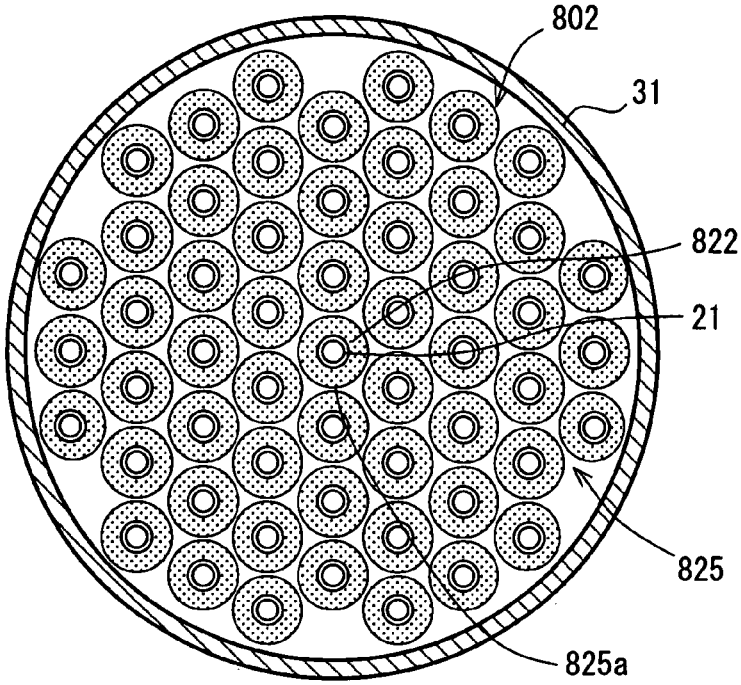
FIG. 27A is a cross-sectional view of an adsorption module according to still another embodiment of the present invention.
Figure 27B:
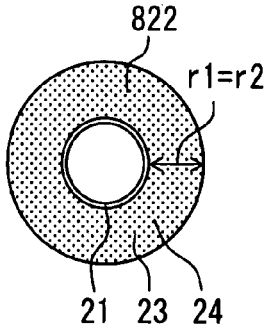
FIG. 27B is a partial enlarged view of the adsorption module shown in FIG. 27A.

Also, in an example shown in FIGS. 27A and 27B, the cylindrical heat medium pipes 21 are arranged in a staggered manner, and the adsorbed medium passage 825 is formed such that the peripheral portions 822 are surrounded by the passage portions 825*a*. Also in this case, the passage portions 825*a* are formed into substantially annular shapes so that each of the peripheral portion 822 is entirely surrounded. In this case, the heat transferring distance r1 and the osmotic distance r2 are substantially equal, as shown in FIG. 27B. Further, the heat transferring distance r1 and the osmotic distance r2 are substantially equal entirely in a circumferential direction of the peripheral portion 822.

In the case that the adsorbed medium passage 825 is formed in the honeycomb shape having the polygonal-shaped passage portions 825*a*, the heat transferring distance r1 and the osmotic distance r2 are set substantially equal entirely along the peripheral portion 822. Here, the polygonal shape means polygon including six or more than six sides, for example.

Additional advantages and modifications will readily occur to those skilled in the art. The invention in its broader term is therefore not limited to the specific details, representative apparatus, and illustrative examples shown and described.

What is claimed is:

1. An adsorption module comprising:

a casing having an adsorbed medium inlet and an adsorbed medium outlet;

a plurality of heat medium pipes disposed within the casing allowing a heat exchange medium to pass through;

a porous heat transferring member disposed within the casing and on peripheries of the heat medium pipes, the porous heat transferring member being a sintered body that is formed by sintering a metallic material in a form of one of powders, particles and fibers, and being connected to outer surfaces of the heat medium pipes by metal-to-metal bonding, the porous heat transferring member including pores allowing an adsorbed medium to pass through;

adsorbent different than the adsorbed medium disposed in the pores of the porous heat transferring member; and a plurality of adsorbed medium passages formed by the porous heat transferring member, each passage allowing the adsorbed medium to flow through the passage, wherein the adsorbed medium passages extend straight and parallel to axes of the heat medium pipes;

each of the heat medium pipes being encircled by two or more adsorbed medium passages;

the adsorbent has a porous structure providing pores absorbing and desorbing the adsorbed medium which is gas-phase refrigerant;

the sintered body of the porous heat transferring member is formed with three-dimensional mesh-like small holes which provide the pores of the porous heat transferring member, the adsorbent is substantially evenly filled in the pores of the porous heat transferring member;

the casing has a communication space in communication with both the adsorbed medium inlet and the adsorbed medium outlet; and the adsorbed medium passages are open to and in communication with the communication space.

2. The adsorption module according to claim 1, wherein the adsorbed medium passages and the heat medium pipes are arranged such that each of a heat transferring distance and an osmotic distance is at least 0.5 mm and at most 6 mm, the heat transferring distance being defined by half of a distance between an outer surface of one heat medium pipe and an outer surface of an adjacent heat medium pipe, and the osmotic distance being defined by a distance from an inner surface of one of the adsorbed medium passages to an outer surface of an adjacent heat medium pipe.

3. The adsorption module according to claim 2, wherein each of the heat transferring distance and the osmotic distance is at least 0.8 mm and at most 4.8 mm.

4. The adsorption module according to claim 3, wherein each of the heat transferring distance and the osmotic distance is at least 1.5 mm and at most 3.8 mm.

5. The adsorption module according to claim 1, wherein each of the heat medium pipes has a flat tubular shape.

6. The adsorption module according to claim 1, wherein the adsorbed medium passages are disposed parallel to axes of the heat medium pipes and allows the adsorbed medium to flow at least in one direction.

7. The adsorption module according to claim 1, wherein each of the adsorbed medium passages includes a plurality of passage portions extending in a direction parallel to axes of the heat medium pipes and in a direction intersecting the axes of the heat medium pipes, and the plurality of passage portions are in communication with each other.

8. The adsorption module according to claim 7, wherein each of the plurality of passage portions has an annular shape in a cross-section defined in a direction perpendicular to the axes of the heat medium pipes.

9. The adsorption module according to claim 1, wherein the porous heat transferring member includes a plurality of peripheral portions, each of which is disposed on a periphery of the heat medium pipe, and each of the adsorbed medium passages include a plurality of passage portions, each of which entirely surrounds the peripheral portion.

10. The adsorption module according to claim 1, wherein:

the adsorbed medium inlet is in communication with an evaporator and the adsorbed medium outlet that is in communication with a condenser; and the porous heat transferring member and the adsorbed medium passages are housed in the casing in a vacuum condition such that the adsorbed medium flows therein from the evaporator through the adsorbed medium inlet pipe during an adsorption and flows out from the casing toward the condenser through the adsorbed medium outlet pipe during a desorption.

11. The adsorption module according to claim 1, wherein the metallic material is one of copper and copper alloy, and the heat medium pipes are made of one of copper and copper alloy.

12. The adsorption module according to claim 1, wherein the adsorbent is in the form of fine particles which can be contained in the pores of the heat transferring member.

13. The adsorption module according to claim 1, wherein the adsorbent is silica gel or zeolite.

14. The adsorption module according to claim 1, wherein the plurality of adsorbed medium passages encircle each of the heat medium pipes via the sintered body of the porous heat transferring member.

15. The adsorption module according to claim 1, wherein the sintered body of the porous heat transferring member is located between the plurality of adsorbed medium passages and each of the heat medium pipes.

16. The adsorption module according to claim 1, wherein the adsorbent is substantially evenly filled in the porous heat transferring member.

17. The adsorption module according to claim 12, wherein the fine particles of the adsorbent are substantially evenly filled in the pores heat transferring member.

18. The adsorption module according to claim 1, wherein the adsorbent absorbs and desorbs only the gas-phase refrigerant.

19. An adsorption module comprising:

a plurality of heat medium pipes allowing a heat exchange medium to pass through;

a porous heat transferring member disposed on peripheries of the heat medium pipes, the porous heat transferring member being a sintered body of a metallic material in a form of one of powders, particles and fibers, the porous heat transferring member being connected to outer surfaces of the heat medium pipes by metal-to-metal bonding, the porous heat transferring member being formed with three-dimensional mesh-like small pores allowing vapor-state adsorbed medium to pass through;

adsorbent being substantially evenly filled in the three-dimensional mesh-like small pores of the porous heat transferring member, the adsorbent being one of silica gel and zeolite having a porous structure absorbing and desorbing the vapor-state adsorbed medium;

a plurality of adsorbed medium passages formed by the porous heat transferring member, each passage allowing the vapor-state adsorbed medium to flow through the passage and being in communication with the three-dimensional mesh-like small pores of the porous heat transferring member, the adsorbed medium passages extend straight and parallel to axes of the heat medium pipes, each of the heat medium pipes being encircled by two or more adsorbed medium passages; and a casing including a casing body, an adsorbed medium inlet pipe that is to be communicated with an evaporator and an adsorbed medium outlet pipe that is to be communicated with a condenser; wherein the heat medium pipes, the porous heat transferring member and the adsorbed medium passages are housed in the casing body in a vacuum condition such that the vapor-state adsorbed medium from the evaporator is supplied to the porous heat transferring member and the adsorbed medium passages through the adsorbed medium inlet pipe during an adsorption and flows out from the casing toward the condenser through the adsorbed medium output pipe during a desorption;

the adsorbed medium passages extend from a first end to a second end of the porous heat transferring member;

the adsorbed medium inlet pipe and the adsorbed medium outlet pipes are coupled to the casing body adjacent to the first end of the porous heat transferring member disposed in the casing body;

the casing body has an adsorbed medium inlet to which the adsorbed medium inlet pipe is coupled and an adsorbed medium outlet to which the adsorbed medium outlet pipe is coupled;

the casing has a communication space adjacent the first end of the porous heat transfer member;

the communication space faces and is in direct communication with both the adsorbed medium inlet and the adsorbed medium outlet;

the first end of the porous heat transferring member including ends of the adsorbed medium passages faces and is in direct communication with the communication space;

during the adsorption, the vapor-state adsorbed medium from the adsorbed medium inlet flows in the porous heat transferring member and the adsorbed medium passages via the communication space; and during the desorption, the vapor-state adsorbed medium desorbed from the adsorbent flows through the porous heat transferring member and the adsorbed medium passages and flows to the adsorbed medium outlet via the communication space.

20. The adsorption module according to claim 19, wherein the adsorbent adsorbs and desorbs only the vapor-state adsorbed medium.

* * * * *